US006795982B2

(12) United States Patent
Noboru et al.

(10) Patent No.: US 6,795,982 B2
(45) Date of Patent: Sep. 28, 2004

(54) FLUSH TOILET

(75) Inventors: Shimbara Noboru, Kitakyushu (JP); Tsukada Ryoichi, Kitakyushu (JP); Watanabe Kazuyuki, Kitakyushu (JP); Hirakawa Tomohiro, Kitakyushu (JP); Uchimura Yoshinobu, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 10/239,697

(22) PCT Filed: Mar. 27, 2001

(86) PCT No.: PCT/JP01/02468

§ 371 (c)(1),
(2), (4) Date: Sep. 25, 2002

(87) PCT Pub. No.: WO01/75238

PCT Pub. Date: Oct. 11, 2001

(65) Prior Publication Data

US 2003/0101509 A1 Jun. 5, 2003

(30) Foreign Application Priority Data

Mar. 31, 2000 (JP) ..... 2000-101259

(51) Int. Cl.[7] ..... E03D 11/02; E03D 11/18

(52) U.S. Cl. ..... 4/425; 4/303; 4/305

(58) Field of Search ..... 4/300, 325, 379, 4/388, 422, 425, 302, 303, 305, 313

(56) References Cited

U.S. PATENT DOCUMENTS

| | | | | |
|---|---|---|---|---|
| 4,014,050 A | * | 3/1977 | Goldsworthy | 4/325 |
| 5,052,060 A | | 10/1991 | Makita et al. | |
| 5,309,942 A | | 5/1994 | Orii et al. | |

FOREIGN PATENT DOCUMENTS

| | | |
|---|---|---|
| JP | 2-35132 | 2/1990 |
| JP | 3-21732 | 1/1991 |
| JP | 6-20576 | 1/1994 |

* cited by examiner

*Primary Examiner*—Tuan N. Nguyen
(74) *Attorney, Agent, or Firm*—Griffin & Szipl, P.C.

(57) ABSTRACT

A flush toilet comprises a toilet body, a water supply pipe connected to supply wash water, a discharge port connected to discharge wash water, a valve disposed between the water supply pipe and the discharge port, a valve switching device connected to switch the valve, a spring operably connected to drive the valve switching device, a mechanical timer and a starter operably connected to supply the spring with strain energy. The spring releases the strain energy accumulated in it to drive the valve switching device, and the mechanical timer consumes a part of the strain energy released from the spring to regulate duration of the operation of the spring.

28 Claims, 19 Drawing Sheets

FLUSH TOILET

TECHNICAL FIELD

The present invention relates to a flush toilet provided with a toilet body, a first means for supplying wash water, a second means for discharging wash water, a third means for operating as a valve disposed between the first means and the second means, a fourth means for switching the third means, a fifth means for driving the fourth means, and a timer for regulating the duration of the operation of the fifth means.

BACKGROUND ART

Flush toilets provided with a toilet body, a first means for supplying wash water, a second means for discharging wash water, a third means for operating as a valve disposed between the first means and the second means, a fourth means for switching the third means, a fifth means for driving the fourth means, and a timer for regulating the duration of the operation of the fifth means are widely used.

In the aforementioned flush toilets, the fifth means drives the fourth means, the fourth means opens the third means to lead wash water to the second means, the second means discharges the wash water to the toilet body to flush it, the fourth means closes the third means to stop supplying the second means with the wash water, and the flushing of the toilet body is finished.

The timer regulates the duration of the operation of the fifth means to regulate the duration of the operation of the fourth means. Thus, the duration of opening the third means is regulated and quantity of the wash water used for flushing the toilet body is regulated.

DISCLOSURE OF INVENTION

The conventional flush toilet is provided with an electric timer. Therefore, the duration of the operation of the fifth means becomes impossible regulate and the flushing of the toilet body becomes impossible to carry out at an electric service interruption.

Therefore, an object of the present invention is to provide a flush toilet provided with a toilet body, a first means for supplying wash water, a second means for discharging wash water, a third means for operating as a valve disposed between the first means and the second means, a fourth means for switching the third means, a fifth means for driving the fourth means, and a timer for regulating the duration of the operation of the fifth means, wherein the toilet body can be flushed even at an electric service interruption.

In accordance with the present invention, there is provided a flush toilet comprising a toilet body, a first means for supplying wash water, a second means for discharging wash water, a third means for operating as a valve disposed between the first means and the second means, a fourth means for switching the third means, a fifth means for driving the fourth means, a mechanical timer and a sixth means for being manipulated to supply the fifth means with strain energy, wherein the fifth means releases the strain energy accumulated in it to drive the fourth means, and the mechanical timer consumes a part of the strain energy released from the fifth means to regulate duration of the operation of the fifth means, and further comprising a seventh means for adjusting the rate of the strain energy consumption by the mechanical timer to adjust the duration of the operation of the fifth means, wherein the seventh means alternatively selects one among a plurality of rates of strain energy consumption different from each other.

In a flush toilet in accordance with the present invention, the toilet body can be flushed even at an electric service interruption because the mechanical timer regulates the duration of the operation of the fifth means.

In accordance with a preferred embodiment of the present invention, the rate of the strain energy consumption by the mechanical timer increases and decreases as the driving velocity of the fifth means increases and decreases.

Resistance against the operation of the fifth means increases and decreases as the strain energy consumption increases and decreases. Therefore, the driving velocity of the fifth means is kept constant and the timing of switching the third means is kept constant even if the driving force of the fifth means fluctuates a little.

In accordance with a preferred embodiment of the present invention, the mechanical timer comprises a generator driven by the fifth means and a current consumer connected to the generator.

The duration of the operation of the fifth means can be adjusted by adjusting the rate of the consumption of the strain energy released from the fifth means. The strain energy released from the fifth means can be consumed as electric power. The current consumer can be adjusted easily Therefore, electric power consumption can be adjusted easily, duration of the operation of the fifth means can be adjusted easily, and the quantity of the wash water used for flushing the toilet body can be adjusted easily.

In accordance with a preferred embodiment of the present invention, the flush toilet further comprises an eighth means for being manipulated to manipulate the seventh means.

The duration of the operation of the fifth means can be adjusted easily by manipulating the seventh means with the eighth means.

In accordance with a preferred embodiment of the present invention, the seventh means is manipulated with the sixth means.

When the seventh means is manipulated with the sixth means, it becomes unnecessary to manipulate another means for adjusting the duration of the operation of the fifth means and the manipulation for adjusting the duration of the operation of the fifth means becomes easy.

In accordance with a preferred embodiment of the present invention, the third means comprises a pilot-operated valve.

When a pilot-operated valve is used, the force necessary for switching the third means decreases, the fifth means is downsized, and the force necessary for manipulating the sixth means decreases.

In accordance with a preferred embodiment of the present invention, the flush toilet further comprises a pipe connecting a pilot valve portion of the pilot-operated valve with a switching valve portion of the pilot-operated valve.

When a pipe connects a pilot valve portion of the pilot-operated valve with a switching valve portion of the pilot-operated valve, it becomes possible to dispose the pilot valve portion distanced from the switching valve portion, and degrees of freedom in arranging the third means increases.

In accordance with a preferred embodiment of the present invention, the flush toilet comprises a plurality of the second means, and the third means comprises a switching valve disposed on a wash water passage extending from the first means and a selector valve for alternatively supplying one of the second means with wash water.

When a plurality of the second means discharge the wash water successively, the flushing of the toilet body becomes efficient and the quantity of the wash water used for flushing the toilet body decreases.

In accordance with a preferred embodiment of the present invention, the selector valve is disposed downstream of the switching valve and connected to the switching valve in series.

The selector valve disposed downstream of the switching valve is not exposed to a high pressure because a pressure loss is generated when the wash water passes through the switching valve. Therefore, the selector valve need not be strengthened for high pressure and can be downsized.

In accordance with a preferred embodiment of the present invention, the flush toilet further comprises a ninth means for being manipulated to open the switching valve.

A large force is necessary for opening the switching valve. When a user of the flush toilet manipulates the ninth means to open the switching valve, the driving force supplied by the fifth means switches the selector valve which is not exposed to a high pressure and does not need a large force to open and close it, and the driving force supplied by the fifth means closes the switching valve which does not need a large force to close it, the fifth means can be downsized and the force necessary for manipulating the sixth means can be reduced.

In accordance with a preferred embodiment of the present invention, the sixth means forms the ninth means.

When the sixth means forms the ninth means, it becomes unnecessary to provide the ninth means and the number of elements decreases.

In accordance with a preferred embodiment of the present invention, the flush toilet further comprises a tenth means for regulating flow rate of the wash water.

The flow rate of the wash water and quantity of the wash water used for flushing the toilet body can be optimized corresponding to the specifications of the flush toilet by regulating the flow rate of the wash water.

In accordance with a preferred embodiment of the present invention, the tenth means is an eleventh means for achieving a constant flow rate.

The eleventh means suppresses the fluctuation of the flow rate of the discharging wash water due to the fluctuation of the pressure of the wash water supplied by the first means. Therefore, it becomes possible to flush the toilet body stably.

In accordance with a preferred embodiment of the present invention, the flush toilet further comprises a case for receiving the third means, the fourth means, the fifth means and the mechanical timer.

When the third means, the fourth means, the fifth means and the mechanical timer are received in a case, it becomes difficult to tamper with the flush toilet in a way that might change the timing of the discharge of the wash water and/or damage the aforementioned devices, etc.

In accordance with a preferred embodiment of the present invention, the flush toilet further comprises a twelfth means for regulating the manipulated variable of the sixth means at a predetermined level.

Regulating the manipulated variable of the sixth means enables the strain energy accumulated in the fifth means to be regulated accurately, the duration of the operation of the fifth means to be regulated accurately, the timing of switching the third means and the timing of discharging the wash water to be regulated accurately, and the quantity of discharging wash water can to regulated accurately.

In accordance with a preferred embodiment of the present invention, the fourth means moves reciprocally and its operation in the outward movement is asymmetrical with that in the homeward movement.

The fourth means with reciprocal movement can be downsized. When the operation of the fourth means in the outward movement is asymmetrical with that in the homeward movement, the manner of discharging the wash water is optimized and the efficiency of flushing the toilet body is enhanced.

In accordance with a preferred embodiment of the present invention, the fourth means is driven only by the fifth means.

When the fourth means is driven only by the fifth means, the duration of the operation thereof can be regulated accurately by the mechanical timer, the timing of switching the third means can be regulated accurately and the quantity of the discharging wash water can be regulated accurately.

In accordance with a preferred embodiment of the present invention, the flush toilet further comprises a thirteenth means for releasing the engagement of the sixth means with the fifth means after the operation of the sixth means for supplying the fifth means with strain energy is completed to return the sixth means to the start point.

When the sixth means returns to the start point just after the manipulation of the sixth means is completed, a user of the flush toilet feels easy.

In accordance with a preferred embodiment of the present invention, the third means closes under the upstream pressure.

When the third means closes under the upstream pressure, no failure in stopping the wash water occurs even if the pressure of the wash water supplied by the first means is high.

In accordance with a preferred embodiment of the present invention, the fourth means comprises a cam.

Various wash water discharge modes can be achieved by changing the shape of the cam.

In accordance with a preferred embodiment of the present invention, the cam is provided with a shape wherein the component of a force applied from the cam to the third means in the direction of switching of the third means is larger than that in the direction at right angles to the aforementioned direction.

When the component of the force applied from the cam to the third means in the direction of switching of the third means is larger than that in the direction at right angles to the aforementioned direction, the driving force of the fifth means can be reduced, the fifth means can be downsized, and the force for manipulating the sixth means can be reduced.

In accordance with a preferred embodiment of the present invention, the fourth means comprises a plurality of cams and the shape of the cam for switching the third means in the outward movement of the fourth means is different from that of the cam for switching the third means in the homeward movement of the fourth means.

When the shape of the cam for switching the third means in the outward movement of the fourth means is different from that of the cam for switching the third means in the homeward movement of the fourth means, the manner of discharging the wash water becomes optimized and the efficiency of flushing the toilet body is enhanced.

In accordance with a preferred embodiment of the present invention, the fourth means comprises a first cam for opening the switching valve and a second cam for closing the switching valve, the first cam has a shape adapted to gradually open the switching valve, and the second cam has a shape adapted to rapidly close the switching valve.

When the switching valve exposed to a high water pressure is opened gradually, the force for opening the switching valve decreases and the fifth means can be downsized. When the switching valve is closed rapidly, the time necessary for flushing the toilet body is reduced.

In accordance with a preferred embodiment of the present invention, the fourth means comprises a third cam for switching the selector valve, and the third cam has a shape adapted to gradually open the selector valve and rapidly close the selector valve.

When the selector valve is opened gradually, the force for manipulating the selector valve is reduced and the fifth means is downsized. When the selector valve is closed rapidly, the time necessary for flushing the toilet body is reduced.

In accordance with a preferred embodiment of the present invention, the fourth means comprises a cam and a fourteenth means for engaging the cam with the third means alternatively at the outward movement of the fourth means or at the homeward movement of the fourth means.

When the cam is engaged with the third means alternatively in the outward movement of the fourth means or in the homeward movement of the fourth means, the operation of the fourth means for switching the third means at its outward movement becomes asymmetrical to that at its homeward movement. Therefore, the manner of discharging the wash water is optimized and the efficiency of flushing the toilet body is enhanced.

In accordance with a preferred embodiment of the present invention, the fourth means comprises a fifteenth means for forcing the fourteenth means to a position where the fourteenth means can engage the cam.

When the fourteenth means is forced to a position where the fourteenth means can engage the cam, the engagement between the fourteenth means and the cam is surely achieved, the operation of the fourth means for switching the third means becomes sure, and the operation of the flush toilet for flushing the toilet body becomes sure.

In accordance with a preferred embodiment of the present invention, the fourteenth means and the cam move reciprocally in one united body.

When the fourteenth means and the cam move reciprocally in one united body, the fourth means is downsized.

In accordance with a preferred embodiment of the present invention, the flush toilet further comprises a sixteenth means for controlling the stroke of the reciprocal movement of the fourth means.

When the stroke of the reciprocal movement of the fourth means is controlled, the timing of switching the third means is controlled and the quantity of the wash water used for flushing the toilet body is controlled.

In accordance with a preferred embodiment of the present invention, the fourth means opens the switching valve in its outward movement.

When the fourth means opens the switching valve in its outward movement, it becomes possible to reduce the stroke of the reciprocal movement of the fourth means, thereby discharging the wash water only from a selected one among a plurality of the second means. Such a manner of discharging the wash water is convenient for cleaning the toilet body.

BEST MODE FOR CARRYING OUT THE INVENTION

A flush toilet in accordance with a first preferred embodiment will be described.

Figure 1:
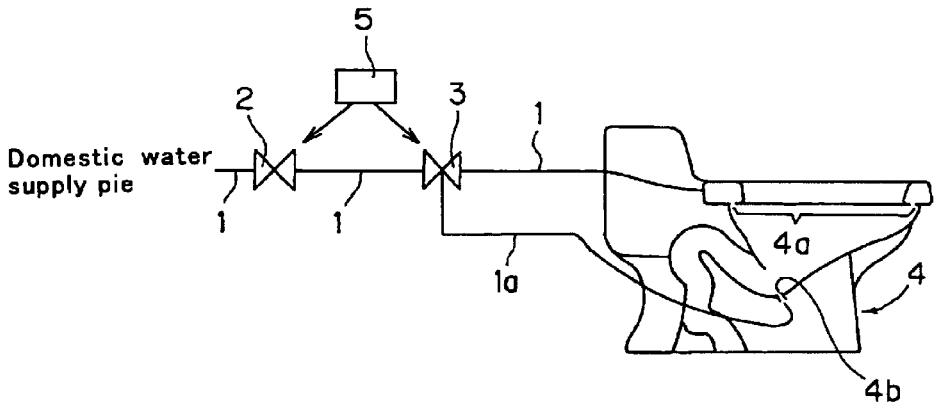
FIG. 1 is a layout diagram of a flush toilet in accordance with a first preferred embodiment of the present invention.

As shown in FIG. 1, a pipe 1 is connected to a domestic water supply pipe. A switching valve 2 and a selector valve 3 are disposed on the pipe 1 in series. The selector valve 3 is disposed downstream of the switching valve 2. The switching valve 2 opens and closes a water passage formed in the pipe 1. The selector valve 3 opens and closes an inlet of a pipe 1*a* branching from the pipe 1. The pipe 1 communicates with rim discharge ports 4*a* formed in a rim of a toilet body 4 at its downstream end. The rim discharge ports 4*a* are directed downward. The pipe 1*a* communicates with a jet discharge nozzle 4*b* disposed on the bottom of a bowl portion of the toilet body 4 at its downstream end. The jet discharge nozzle 4*b* is directed toward a trap discharging passage of the toilet body.

A valve controller 5 is disposed to control the operations of the switching valve 2 and the selector valve 3.

Figure 2:
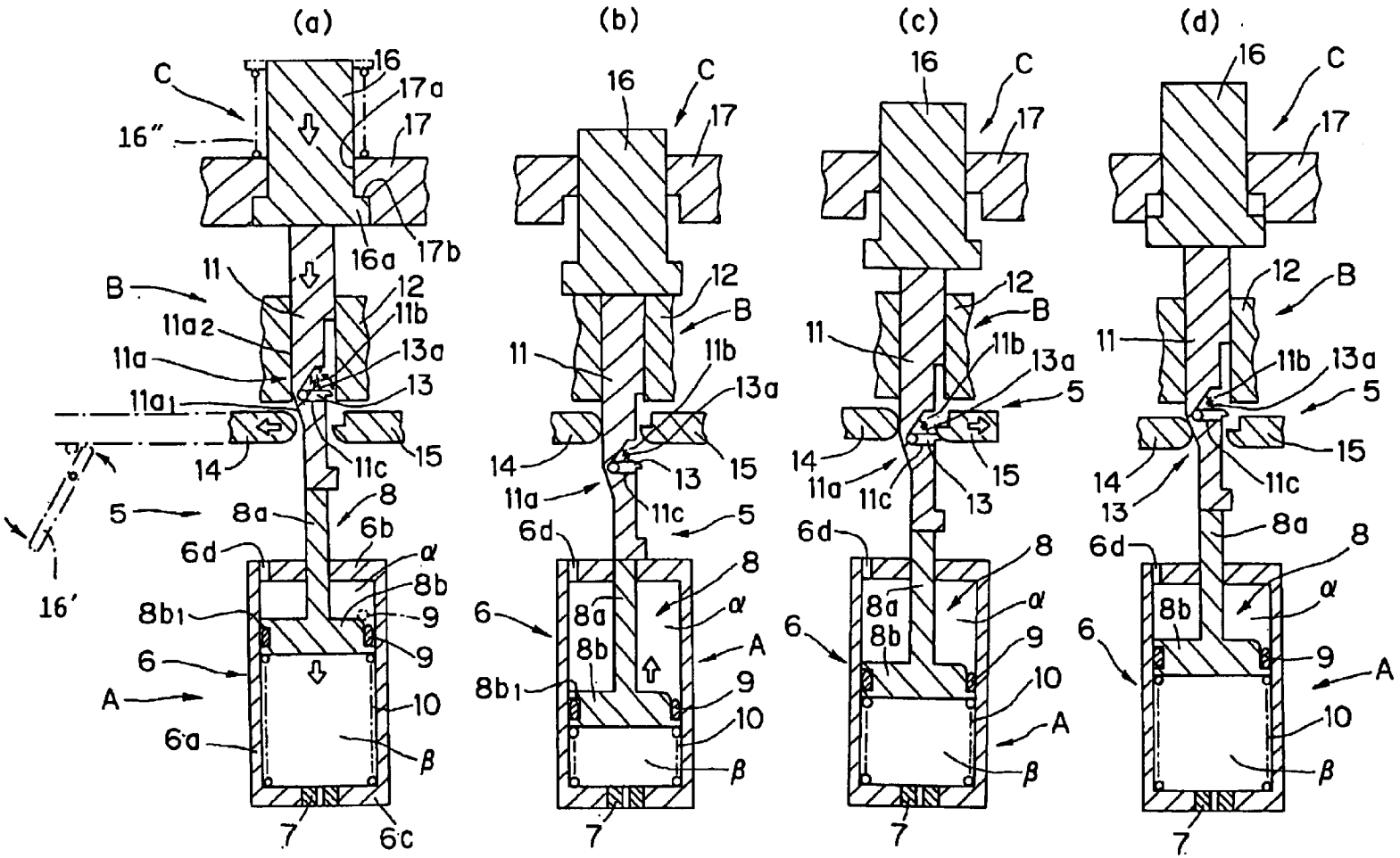
FIG. 2 is a sectional view of a valve controller provided for the flush toilet in accordance with the first preferred embodiment of the present invention.

As shown in FIG. 2(*a*), the valve controller 5 is provided with a mechanical timer A which also serves as a driving device, a valve switching device B and a start button C.

The mechanical timer A is provided with a cylinder 6. The cylinder 6 is provided with a circumferential wall 6*a* and end walls 6*b* and 6*c*. The end wall 6*b* is provided with an air hole 6*d*. The end wall 6*c* is provided with an orifice 7.

A piston 8 is inserted in the cylinder 6. The piston 8 is provided with a piston rod 8*a* and a piston head 8*b*. The piston rod 8*a* penetrates the end wall 6*b* to slide. The piston head 8*b* abuts against the inner circumferential surface of the cylindrical wall 6*a* of the cylinder to slide. The abutment is sealed with an O-ring 9. The O-ring 9 is received in a groove $\mathbf{8}b_1$ formed in the circumferential surface of the piston head 8*b*. A side wall of the groove $\mathbf{8}b_1$ opposite the end wall 6*b* of the cylinder 6 is cut out partially over an appropriate length. A chamber α is formed between the piston head 8*b* and the end wall 6*b* and a chamber β is formed between the piston head 8*b* and the end wall 6*c*. A coil spring 10 is disposed in the chamber B.

The valve switching device B is provided with a spindle 11. The spindle 11 abuts against the free end of the piston rod 8*a* at its one end. The spindle 11 is inserted in a guide hole formed in a guide member 12 to be movable in the longitudinal direction. The spindle 11 is provided with a cam 11*a* on its one side surface. The cam 11*a* is provided with a slope $\mathbf{11}a_1$ adapted to increase the diameter of the spindle 11 from one end abutting against the free end of the piston rod 8*a* toward the other end and a straight surface $\mathbf{11}a_2$ connecting to the end of the slope $\mathbf{11}a_1$.

The spindle 11 is provided with a concave 11*b* on it's the other side surface. A surface of the concave 11*b* crossing at right angles with the longitudinal axis of the spindle 11 forms a cam 11*c*. A cam engaging member 13 is disposed in the concave 11*b*. The cam engaging member 13 is connected to the spindle 11 to swing between a first position indicated by a solid line in FIG. 2(*a*) where the cam engaging member 13 abuts against the cam 11*c* to project outward in the radial direction from the spindle 11 at its one end and a second position indicated by a phantom line in FIG. 2(*a*) where the cam engaging member 13 leaves the cam 11*c* to be received in the concave 11*b* as a whole. The cam engaging member 13 stays at the first position under the force of a weak return spring 13*a* when no load is applied to the cam engaging member 13.

A cam rod 14 is disposed opposite the cam 11*a* of the spindle 11 and at right angles to the longitudinal axis of the spindle 11. A cam rod 15 is disposed opposite the cam engaging member 13 and at right angles to the longitudinal axis of the spindle 11. The cam rod 14 is connected to the switching valve 2. The cam rod 15 is connected to the selector valve 3.

The start button C is provided with a button body 16. The button body 16 is inserted in a guide hole 17*a* formed in a guide member 17 to move in the longitudinal direction. The button body 16 is provided with a flange 16*a* at its one end. The guide hole 17*a* is provided with a step 17*b* for receiving the flange 16*a*. The button body 16 abuts against the other end of the spindle 11 at its one end provided with the flange 16*a*.

Figure 3:
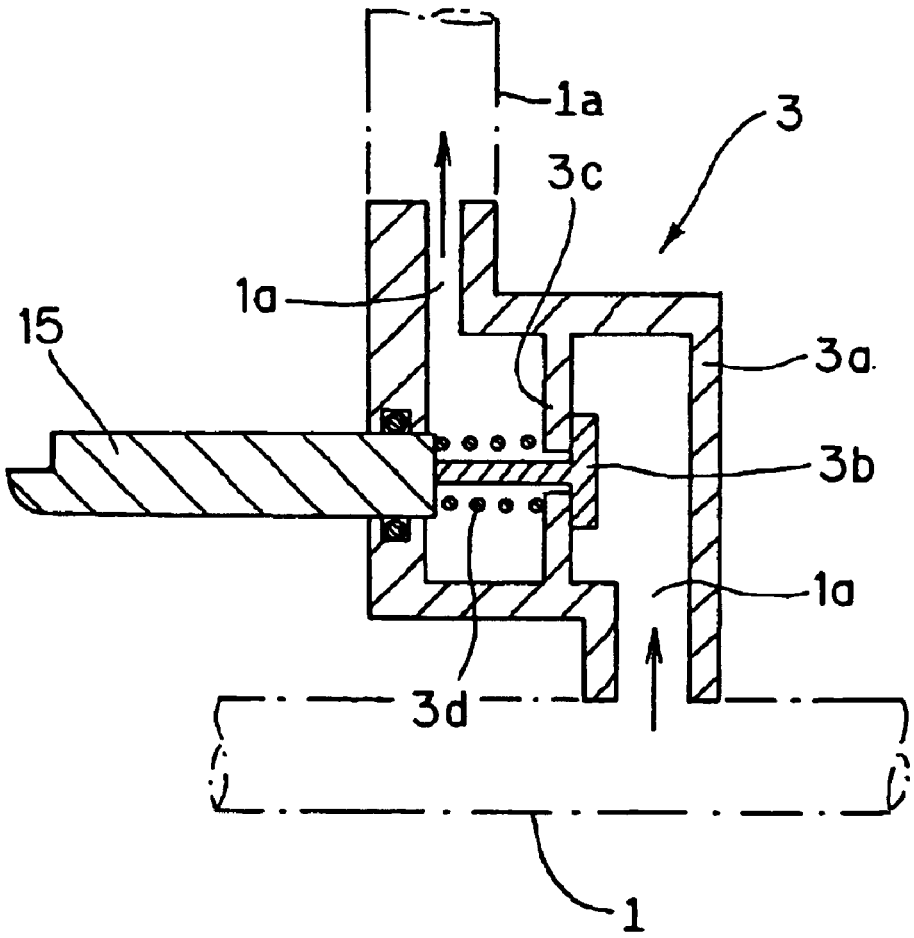
FIG. 3 is a sectional view of a switching valve provided for the flush toilet in accordance with the first preferred embodiment of the present invention.

Structure of the selector valve 3 is shown in FIG. 3. The selector valve 3 is provided with a case 3*a* connected to the pipes 1 and 1*a*, a valve body 3*b* and a valve seat 3*c*. The cam rod 15 is fixed to the valve body 3*b*. A coil spring 3*d* is disposed between them. The coil spring 3*d* forces the valve body 3*b* to abut it against the valve seat 3*c*. When no external load is applied to the cam rod 15, the valve body 3*b* abuts against the valve seat 3*c* under the biasing force of the coil spring 3*d* and the upstream pressure to close the inlet of the pipe 1*a*. When an external load is applied to the cam rod 15 and the cam rod 15 is forced toward the valve body 3*b*, the valve body 3*b* leaves the valve seat 3*c* against the biasing force of the coil spring 3*d* to open the inlet of the pipe 1*a*. As indicated by arrows, a part of the wash water passing through the pipe 1 flows into the pipe 1*a* through the selector valve 3.

The switching valve 2 has the same structure as the selector valve 3.

The switching valve 2, the selector valve 3, the valve controller 5, etc. are disposed in a receiving space formed in the toilet body 4. The receiving space is not shown in Figures.

The operation of the flush toilet in accordance with the present preferred embodiment will be described.

When the flush toilet is not being used, the valve controller 5 is in the initial condition as shown in FIG. 2(*a*). The switching valve 2 closes the water passage formed in the pipe 1 and the selector valve 3 closes the inlet of the pipe 1*a*.

The button body 16 of the start button C projects from the guide member 17 forming a ceiling of the receiving space in the toilet body 4. The flange 16*a* abuts against the step 17*b*.

The spindle 11 of the valve switching device B is located at the start point and projects from the guide member 12. The cam engaging member 13 is located at the first position. The cam rod 14 is located between the cam 11*a* and the end wall 6*b* of the cylinder 6. The cam rod 15 is located between the cam engaging member 13 and the end wall 6*b* of the cylinder 6.

A user of the flush toilet manually pushes the button body 16 of the start button C in the guide member 17 to start flushing the toilet body. As indicated by void arrows in FIG. 2(*a*), the button body 16 starts to move toward the cylinder 6, the spindle 11 starts outward movement from the start point toward the cylinder 6, and the piston head 8*b* starts to move in the cylinder 6 toward the end wall 6*c*, while compressing the coil spring 10 to supply the coils spring 10 with strain energy.

As indicated by a phantom line in FIG. 2(*a*), the O-ring 9 is exposed to a friction force from the circumferential wall 6*a* of the cylinder 6 to be extruded partially from the groove $8b_1$ through the cutout formed in the side wall of the groove $8b_1$. Thus, the seal by the O-ring 9 is broken. Air in the chamber β with its volume decreasing flows into the chamber α with its volume increasing through a space between the piston head 8*b* and the circumferential wall 6*a* of the cylinder 6. Air flows into the chamber a with its volume increasing through an air hole 6*d* formed in the end wall 6*b* of the cylinder 6.

The cam 11*a* of the spindle 11 engages the cam rod 14 to engage the switching valve 2 through the cam rod 14. The cam 11*a* forces the cam rod 14 away from the spindle 11 as indicated by a void arrow to open the switching valve 2 through the cam rod 14 against the water pressure in the pipe 1.

Wash water flows into the pipe 1 downstream of the switching valve 2. The wash water reaches the rim discharge holes 4*a* through the pipe 1 to discharge from the rim discharge holes 4*a*, thereby flushing the inner surface of the upper part of the bowl of the toilet body 4.

When the cam engaging member 13 contacts with the cam rod 15, it swings from the first position to the second position under a load applied by the cam rod 15. Therefore, the cam 11*c* does not engage the cam rod 15 through the cam engaging member 13, does not engage the selector valve 3 through the cam engaging member 13 and the cam rod 15, and does not open the selector valve 3. Therefore, the selector valve 3 continues to close the inlet of the pipe 1*a*.

As shown in FIG. 2(*b*), the button body 16 of the start button C abuts against the guide member 12 to stop moving, the spindle 11 reaches the end point to stop moving, thereby finishing outward movement, and the manipulation to start flushing the toilet body is finished. When the manipulation to start flushing the toilet body is finished, the cam engaging member 13 is released from engaging the cam rod 15, and the cam engaging member 13 returns to the first position under the biasing force of the return spring 13*a*.

When the user of the flush toilet removes his or her hand from the button body 16 of the start button C, the compressed coil spring 10 starts to release the accumulated strain energy and elongate. As indicated by a void arrow in FIG. 2(*b*), the piston head 8*b* starts to move toward the end wall 6*b* of the cylinder 6, the spindle 11 starts homeward movement from the end point to the start point, and the button body 16 starts to move away from the guide member 12. The O-ring 9 is exposed to a friction force from the circumferential wall 6*a* of the cylinder 6 to return into the groove 8*b* through the cutout formed in the side wall of the groove $8b_1$. Thus, the seal by the O-ring 9 is restored. Air flows into the chamber β with its volume increasing through the orifice 7 and air flows out the chamber α with its volume decreasing through the air hole 6*d*. A part of the strain energy released from the coil spring 10 is consumed to become the heat when the air passes through the orifice 7. The increase rate of the volume of the chamber β and the velocity of the homeward movement of the spindle 11 are regulated by the flow rate of the air passing through the orifice 7. The flow rate of the air passing through the orifice 7 is regulated by the diameter of the orifice 7. The spindle 11 moves homeward at a substantially constant velocity determined by the spring constant of the coil spring 10 and the diameter of the orifice 7.

The elongation speed of the coil spring 10 is regulated, the time necessary for the coil spring 10 to return from the condition shown in FIG. 2(*b*) to the condition shown in FIG. 2(*a*) is regulated, and the duration of operation of the coil spring 10 is regulated due to the fact that a part of the strain energy released from the coil spring 10 is consumed to become heat when the air passes through the orifice 7.

When the spindle 11 moves from the end point to the start point by a predetermined distance, or when a predetermined length of time lapses from the finish of the manipulation for starting the flushing, the cam engaging member 13 abuts against the cam rod 15 as shown in FIG. 2(*c*). Though a load is applied to the cam engaging member 13 by the cam rod 15, the cam engaging member 13 is only forced against the cam 11*c* and does not swing because the cam engaging member 13 is already returned to the first position under the biasing force of the return spring 13*a*. Therefore, the cam 11*c* engages the cam rod 15 through the cam engaging member 13 and engages the selector valve 3 through the cam engaging member 13 and the cam rod 15.

The cam 11*c* forces the cam rod 15 away from the spindle 11 as indicated by a void arrow to open the selector valve 3 against the water pressure in the pipe 1. A part of the wash water flows into the pipe 1*a*. Therefore, a part of the wash water passes through the pipe 1 to discharge from the rim discharge holes 4*a*, thereby flushing the upper part of the inner surface of the bowl of the toilet body 4, while the other part of the wash water passes through the pipe 1*a* to discharge from the jet discharge nozzle 4*b*, thereby inducing a siphon phenomenon in the trap discharging passage of the toilet body 4 and flushing the sewage in the bowl to an external discharging pipe.

When the spindle 11 moves further from the position shown in FIG. 2(*c*))) toward the start point, or when a predetermined length of time lapses from the point of time shown in FIG. 2(*c*), the cam 11*c* is released from engaging the cam rod 15 through the cam engaging member 13 as shown in FIG. 2(*d*). The selector valve 3 is released from the load by the cam rod 15 to close under the upstream pressure. The cam rod 15 moves and comes close to the spindle 11 as the selector valve 3 closes. When the selector valve 3 closes, the flow of the wash water into the pipe 1*a* stops, and the discharge of the wash water from the jet discharge nozzle 4*b* stops. The cam 11*a* still engages the cam rod 14 and the switching valve 2 still opens. The wash water flows to the rim discharge holes 4*a* through the pipe 1 and discharges from the rim discharge holes 4*a* to form water seal in the bowl.

When a predetermined length of time lapses from the point of time shown in FIG. 2(*d*), the flange 16*a* of the button body 16 of the start button C abuts against the step 17*b* of the guide member 17, the button body 16 stops moving, and the spindle 11 returns to the start point and stops moving. The cam 11*a* is released from engaging the cam rod 14, the switching valve 2, released from the load by the cam rod 14 closes under the upstream pressure, the cam rod 14 moves and comes close to the spindle 11 as the switching valve 2 closes, and the valve controller 5 comes to the initial condition shown in FIG. 2(*a*). When the switching valve 2 closes, the flow of the wash water into the pipe 1 downstream of the switching valve 2 stops, and the flushing of the toilet body is finished.

Flushing operation of the toilet body becomes efficient and a water saving in the flushing operation of the toilet body is achieved as the wash water is discharged in order from the rim discharge holes 4*a* and the jet discharge nozzle 4*b*.

Figure 4:
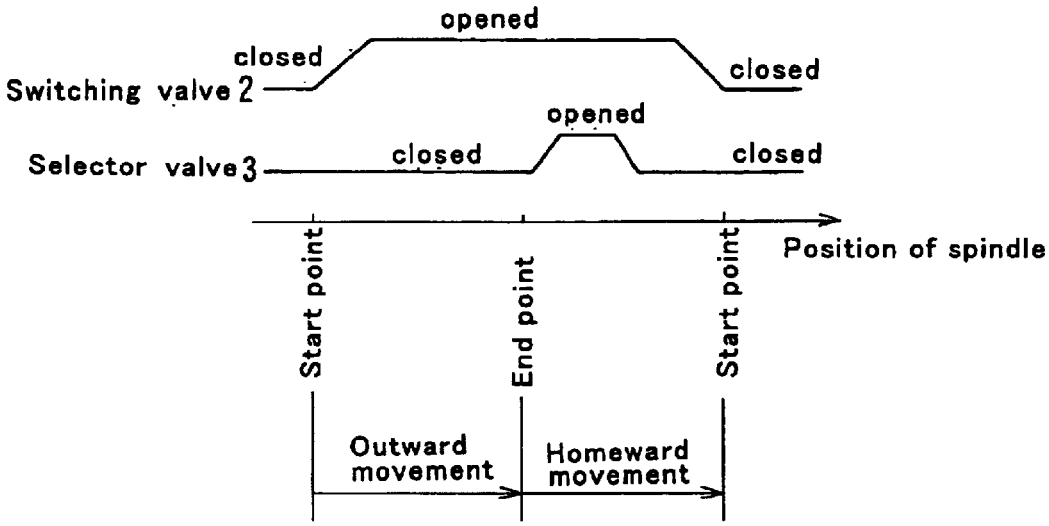
FIG. 4 is a diagram showing relations between the movement of a valve switching device and the switching operations of the switching valve and a selector valve in the flush toilet in accordance with the first preferred embodiment of the present invention.

A relation between the movement of the spindle 11 of the valve switching device B and the switching operation of the switching valve 2 and a relation between the movement of the spindle 11 of the valve switching device B and the switching operation of the selector valve 3 in the flush toilet in accordance with the present preferred embodiment are shown in FIG. 4.

Figure 5:
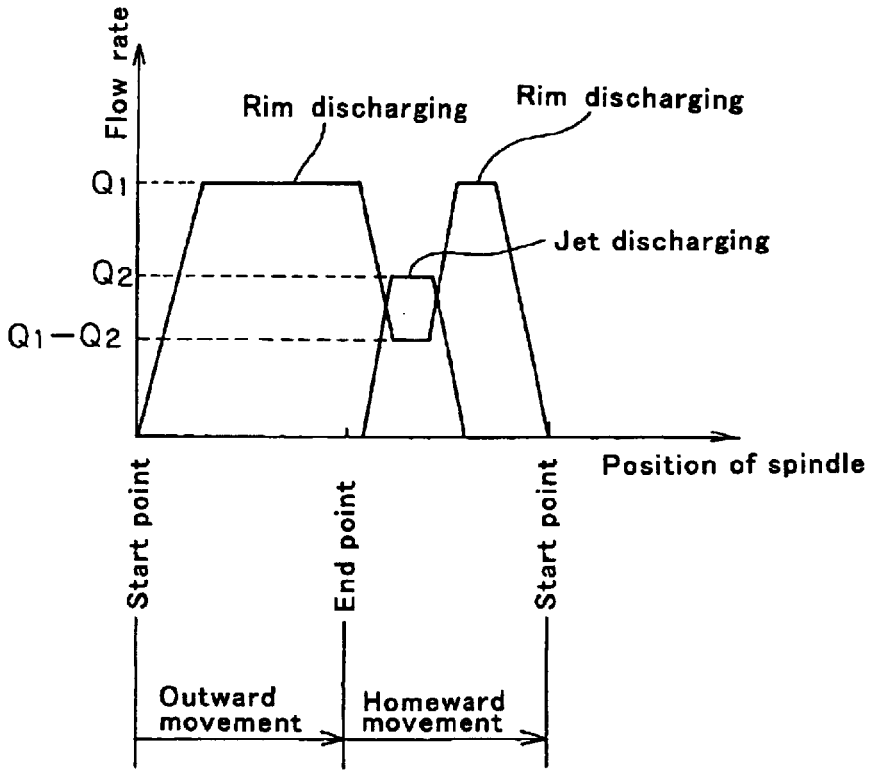
FIG. 5 is a diagram showing a relation between the movement of the valve switching device and the pattern of discharging the wash water in the flush toilet in accordance with the first preferred embodiment of the present invention.

As can be seen from FIG. 4, the switching operation of the selector valve 3 due to the outward movement of the spindle 11 is asymmetrical to the switching operation of the selector valve 3 due to the homeward movement of the spindle 11. In the flush toilet in accordance with the present preferred embodiment, the relation between the timing of the rim discharging and the timing of the jet discharging is therefore optimized as shown in FIG. 5, the jet discharging starts after the rim discharging has been continued for a predetermined period and the surface of the water seal in the bowl of the toilet body has risen to a level sufficient to promptly generate the siphon phenomenon in the trap discharging passage, and a water saving in the flushing operation of the toilet body is achieved.

In the flush toilet in accordance with the present preferred embodiment, the mechanical timer A regulates the velocity of the homeward movement of the spindle 11 of the valve switching device B to regulate the timing of switching the selector valve 3 and the timing of closing the switching valve 2. When the timings of switching the selector valve 2 and the switching valve 3 are regulated to regulate properly the timings of the rim discharging and the jet discharging, the wash water is saved.

In the flush toilet in accordance with the present preferred embodiment, the toilet body can be flushed even at the electric service interruption because the mechanical timer A drives the valve switching device B to switch the selector valve 2 and the switching valve 3.

The velocity of the air passing through the orifice 7 fluctuates and the rate of heating value at the orifice 7 or the rate of energy consumption of the mechanical timer A fluctuates as the velocity of the homeward movement of the piston 8 fluctuates. The resistance against the movement of the piston 8 fluctuates as the rate of energy consumption of the mechanical timer A fluctuates. Therefore, the velocity of the homeward movement of the piston 8 is kept constant even if the spring constant of the coil spring 10 differs a little from the specified value and the driving force applied to the piston 8 by the coil spring 10 differs a little from the specified value. Therefore, the timing of switching the selector valve 3 and the timing of closing the switching valve 2 are kept constant.

In the flush toilet in accordance with the present preferred embodiment, the switching valve 2 and the selector valve 3 are disposed in series and the selector valve 3 is disposed downstream of the switching valve 2. Pressure loss is generated when the wash water passes through the switching valve 2 to make the upstream pressure of the selector valve 3 lower than the upstream pressure of the switching valve 2. Therefore, the selector valve 3 can be less resistive to the pressure than the switching valve 2 and can be downsized.

The valve switching device B reciprocally moving to switch valves can be downsized. Thus, the valve controller 5 can be downsized. The mechanical timer A can be started by a single operation of pushing the button body 16 of the start button C to the stop position.

In the flush toilet in accordance with the present preferred embodiment, the valve switching device B is provided with the cam engaging member 13 for engaging the cam 11*c* with the selector valve 3 only in the homeward movement. Therefore, the valve switching device B can switch the selector valve 3 in the homeward movement asymmetrically in the outward movement, the relation between the timing of the rim discharging and the timing of the jet discharging can be optimized, and the wash water can be saved.

The cam 11*c* reliably engages the cam rod 15 because the cam engaging member 13 already returned to the first position under the biasing force of the return spring 13*a*. Therefore, the cam 11*c* reliably engages the selector valve 3 through the cam rod 15, and the selector valve 3 is reliably opened. Thus, the toilet body can be reliably flushed.

The cam 11*c* and the cam engaging member 13 connected to the spindle 11 move reciprocally in one united body. When the cam engaging member 13 is independent of the spindle 11, the cam engaging member 13 must be distanced from the spindle 11. Thus, the valve switching device B becomes large.

The valve body 3*b* of the selector valve 3 abuts the valve seat 3*c* under the upstream pressure to close the pipe 1*a*. Therefore, the force necessary for closing the selector valve 3 decreases, the valve controller 5 is downsized, and the force necessary for manipulating the start button C decreases. The switching valve 2 provided with the same structure as the selector valve 3 also closes under the upstream pressure. Therefore, the switching valve 2 can be reliably closed even if the upstream pressure is high.

The stroke of the downward movement of the button body 16 of the start button C is regulated by the guide member 12. Therefore, the strain energy accumulated in the coil spring 10 is controlled accurately, the duration of the operation of the coil spring 10 is controlled accurately, the timing of the switching of the switching valve 2 and the timing of the switching of the selector valve 3 are controlled accurately, and the timing of the discharging of the wash water is controlled accurately. Thus, the quantity of the discharging wash water is controlled accurately.

The switching valve 2 opens only in the outward movement of the valve switching device B. Therefore, it is possible to reduce the stroke of the downward movement of the button body 16 of the start button C, thereby switching the switching valve 2 only, keeping the cam 11 from engaging the cam rod 15 through the cam engaging member 13 during the homeward movement of the valve switching device B, and keeping the selector valve 3 from switching. Such a manner of discharging the wash water is convenient for cleaning the toilet body.

The opening operation of the switching valve 2, which requires a large force, is carried out by pushing down the start button C manually. Therefore, the coil spring 10 carries out the switching operation of the selector valve 3 and the closing operation of the switching valve 2 only, which do not need large forces. Therefore, the coil spring 10 can be downsized. The operation for supplying the coil spring with the strain energy and the operation for opening the switching valve 2 is carried out by pushing down the start button C. When the aforementioned two operations are carried out independently by manipulating devices independent of each other, the number of the members increases.

A flush toilet in accordance with a second preferred embodiment of the present invention will be described.

Figure 6:
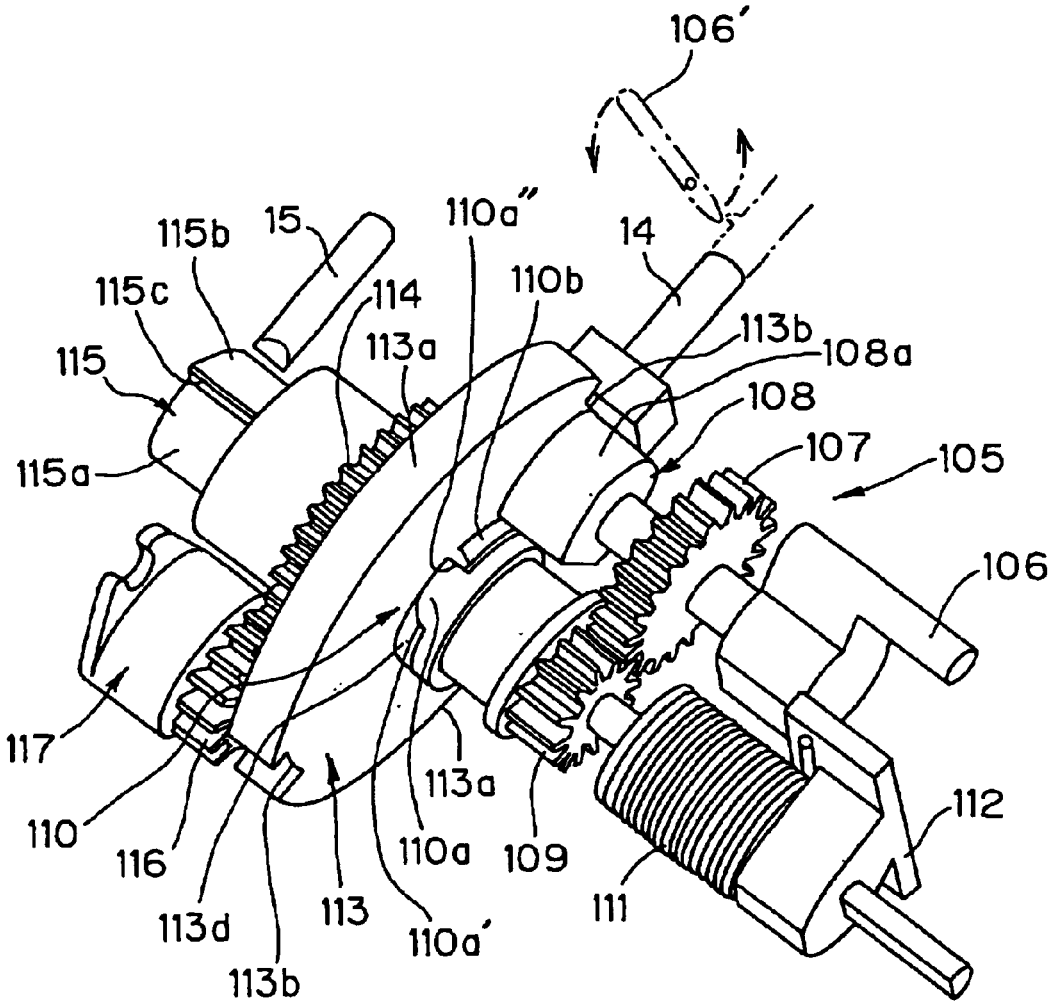
FIG. 6 is a perspective view of a valve controller provided for a flush toilet in accordance with a second preferred embodiment of the present invention.
Figure 7:
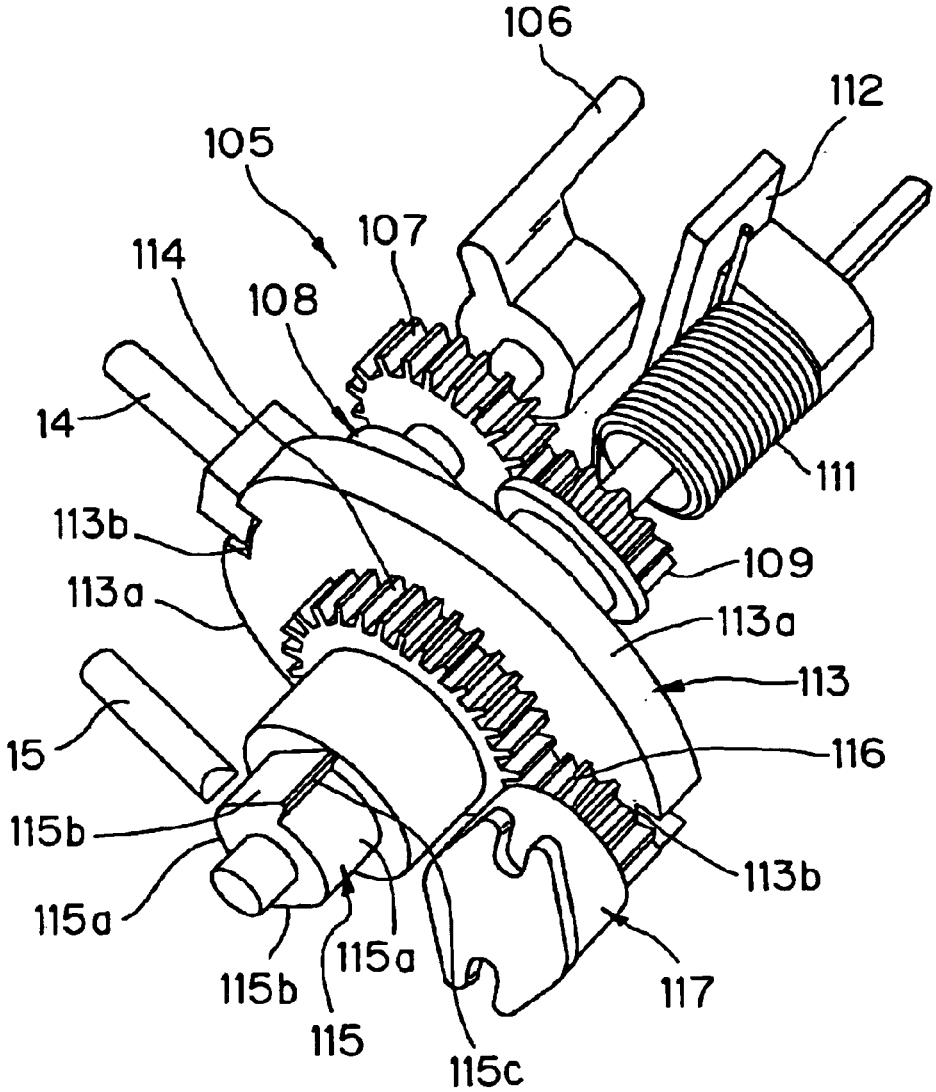
FIG. 7 is a perspective view of a valve controller provided for a flush toilet in accordance with a second preferred embodiment of the present invention.

A flush toilet in accordance with the present preferred embodiment is provided with a valve controller 105 shown in FIGS. 6 and 7 instead of the valve controller 5 in the flush toilet in accordance with the first preferred embodiment. The structure of the valve controller 105 will be described in detail.

Figure 8:
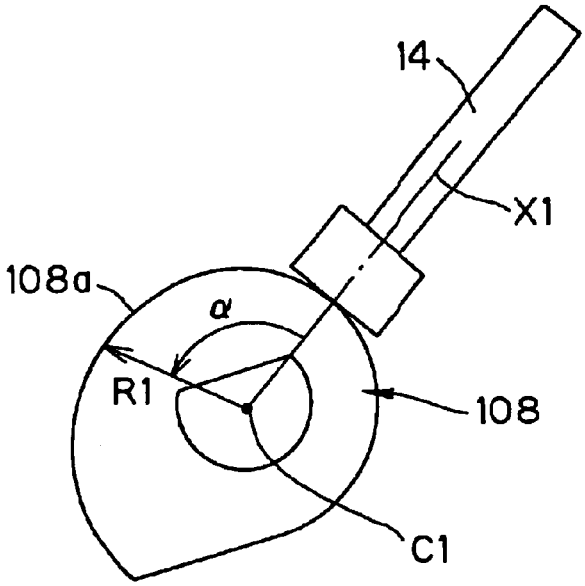
FIG. 8 is a front view of a first cam provided for the valve controller of FIGS. 6 and 7 seen from the right in FIG. 6.

The valve controller 105 is provided with a control lever 106, a first gear 107 and a first cam 108 which are directly connected to the control lever 105. As shown in FIG. 8, the first cam 108 is provided with a cam surface 108*a*. The cam surface 108*a* is provided with a radius R1 around the center of rotation C1 of the cam 108 which gradually increases as the central angle a measured anticlockwise from a baseline X1 extending from the center of rotation C1 increases and becomes maximum at the point where the central angle $\alpha$ is 180 degrees. A cam rod 14 extending along the baseline X1 abuts the cam surface 108*a*.

Figure 9:
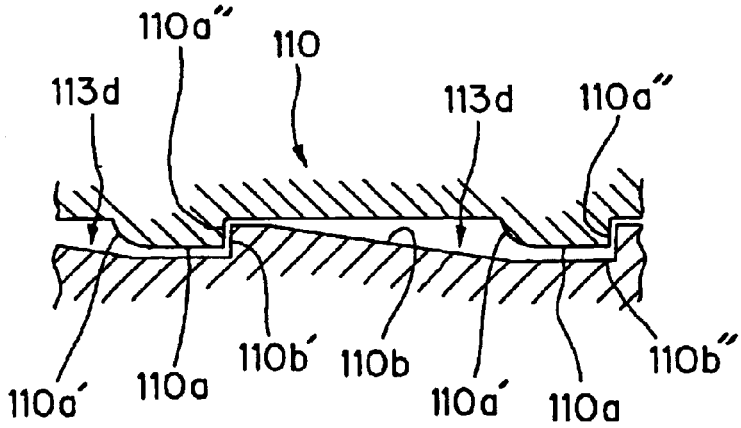
FIG. 9 is a longitudinal sectional view of a clutch projection provided for the valve controller of FIGS. 6 and 7.

A second gear 109 meshes with the first gear 107. A pair of clutch projections 110*a* are connected to the second gear 109. The clutch projections 110*a* cannot rotate relatively to the second gear 109 but can move relatively to the second gear 109 along the central axis of the second gear 109. The clutch projections 110*a* are forced away from the second gear 109 by a spring not shown in Figures. The clutch projections 110*a* are distanced from each other by 180 degrees in the circumferential direction. As shown in FIGS. 6 and 9, each of the clutch projections 110*a* is provided with a fore end 110*a*' projecting roundly and smoothly and a rear end 110*a*" concaving perpendicularly. A helical coil spring 111 is connected directly to the second gear 109. A stopper 112 engaging the helical coil spring 111 and capable of engaging the control lever 106 is provided.

Figure 10:
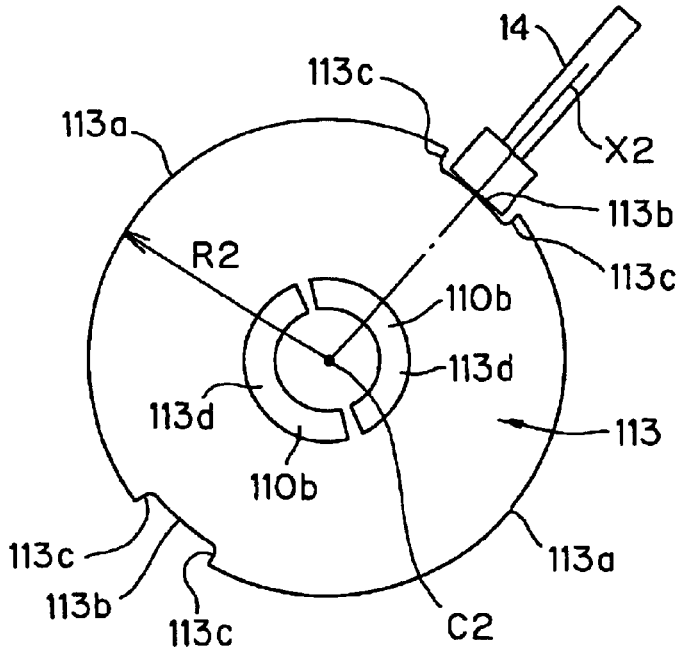
FIG. 10 is a front view of a second cam provided for the valve controller of FIGS. 6 and 7 seen from the right in FIG. 6.

As shown in FIGS. 6 and 7, a second cam 113 is disposed adjacent to the first cam 108. As shown in FIG. 10, the second cam 113 is provided with a circular arc shaped first cam surface 113*a* with a constant radius R2 around the center of rotation C2. The first cam surface 113*a* is cut out over a predetermined central angle to both sides of a cross point between a baseline X2 extending in parallel with the baseline X1 from the center of rotation C2 and the cam surface 113*a* to form a second cam surface 113*b*. The first cam surface 113*a* is also cut out over a predetermined central angle to both sides of a point distanced from the aforementioned cross point by 180 degrees in the circumferential direction to form another second cam surface 113*b*. Connections 113*c* between the first cam surface 113*a* and the second cam surfaces 113*b* concave perpendicularly from the first cam surface 113*a* to the second cam surfaces 113*b*. A cam rod 14 abuts one of the second cam surfaces 113*b*.

The second cam 113 is provided with a pair of semi-annular grooves 113*d* extending around the center of rotation C2 at its one end face. Bottom surfaces of the semi-annular grooves 113*d* form a pair of clutch projections 110*b*. As shown in FIG. 9, each of the clutch projections 110*b* is provided with a fore end 110*b*' concaving perpendicularly and a rear end 110*b*' extending flat. A gentle slope extending from the rear end 110*b*' to the fore end 110*b*' is formed. The clutch projections 110*b* are opposite the clutch projections 110*a*.

A clutch 110 is formed by the clutch projections 110*a* and 110*b*. The clutch projections 110*a* and 110*b* are made of a material with small frictional resistance. The clutch projections 110*a* are forced to the clutch projections 110*b* by a spring not shown in Figures.

The clutch projections 110*a* and 110*b* form a clutch 110. The clutch projections 110*a* and 110*b* are made of material with small frictional resistance. The clutch projections 110*a* are forced against the clutch projections 110*b* by a spring not shown in Figures.

Figure 11:
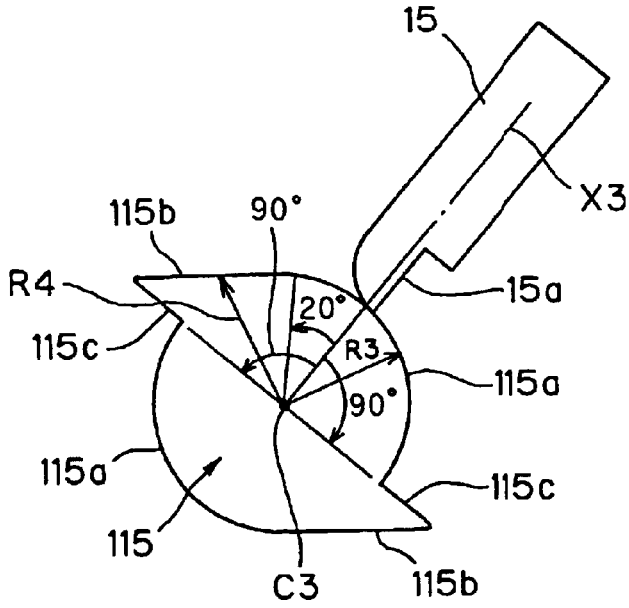
FIG. 11 is a front view of a third cam provided for the valve controller of FIGS. 6 and 7 seen from the right in FIG. 6.

As shown in FIGS. 6 and 7, a third gear 114 and a third cam 115 are connected directly to the second cam 113. As shown in FIG. 11, the third cam 115 is provided with a circular arc shaped first cam surface 115*a* with a constant radius R3 around a center of rotation C3 extending anti-clockwise over a central angle of about 110 degrees from a position of central angle of 90 degrees measured clockwise from a baseline X3 extending from the center of rotation C3 in parallel with the baseline X1 and a straight second cam surface 115*b* extending from a position of central angle of 20 degrees to a position of central angle of 90 degrees measured anticlockwise from the baseline X3.

Radius R4 of the second cam surface 115*b* around the center of rotation C3 gradually increases as the central angle increases. Another first cam surface 116*a* and another second cam surface 115*b* are formed by rotating the first cam surfaces 115*a* and the second cam surface 115*b* by 180 degrees around the center of rotation C3. Connection between the second cam surface 115*b* and the first cam surface 115*a* concaves perpendicularly from the second cam surface 115*b* to the first cam surface 115*a*. A cam rod 15 extending along the baseline X3 abuts the first cam surface 115*a* of the third cam 115. The cam rod 15 is provided with a step 15*a* at its end abutting the third cam 115.

As shown in FIGS. 6 and 7, a fourth gear 116 meshes with the third gear 114.

A mechanical timer 117 is disposed to operatively engage the third gear 114. The structure of the mechanical timer 117 will be described in detail.

Figure 12:
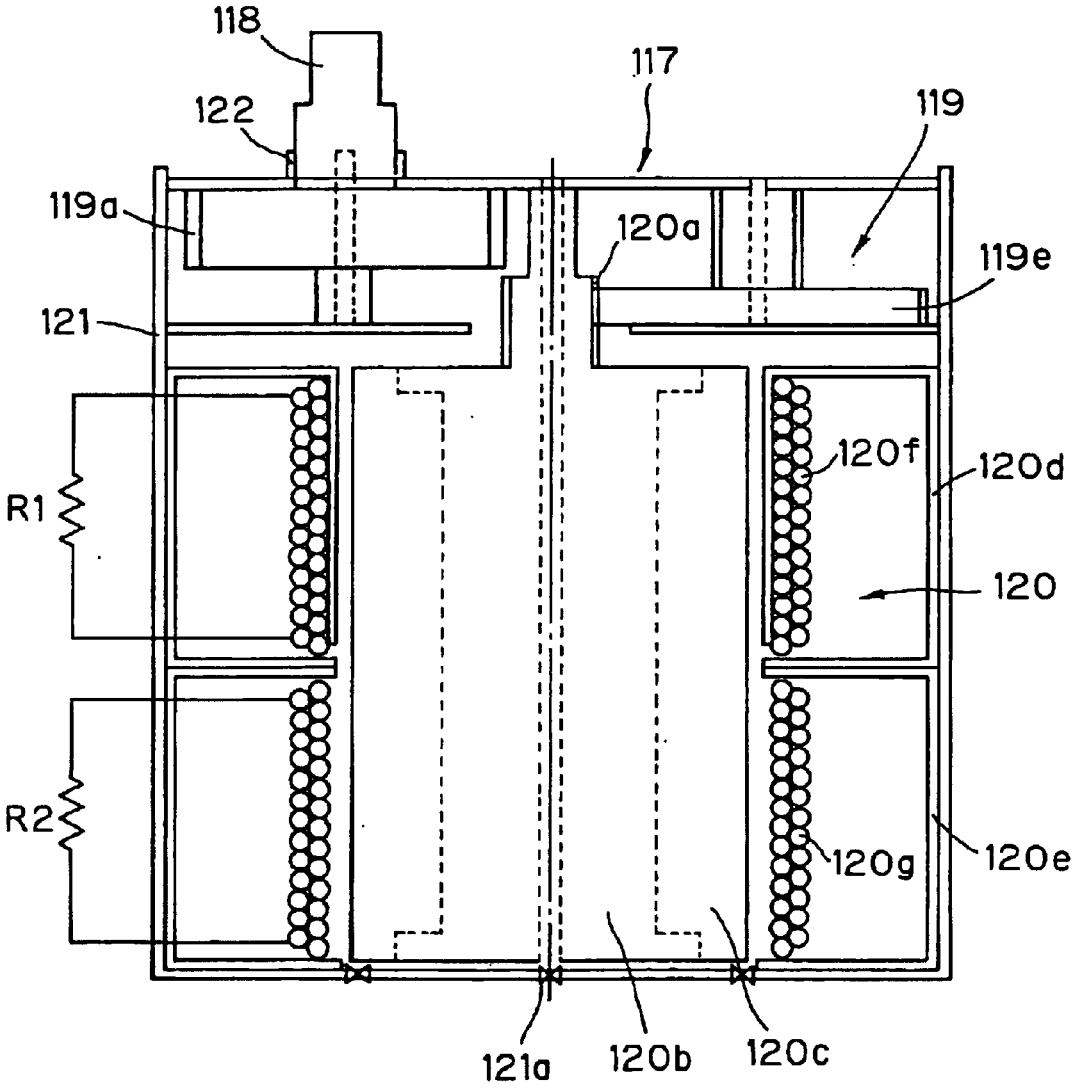
FIG. 12 is a longitudinal sectional view of a mechanical timer provided for the valve controller of FIGS. 6 and 7.
Figure 13:
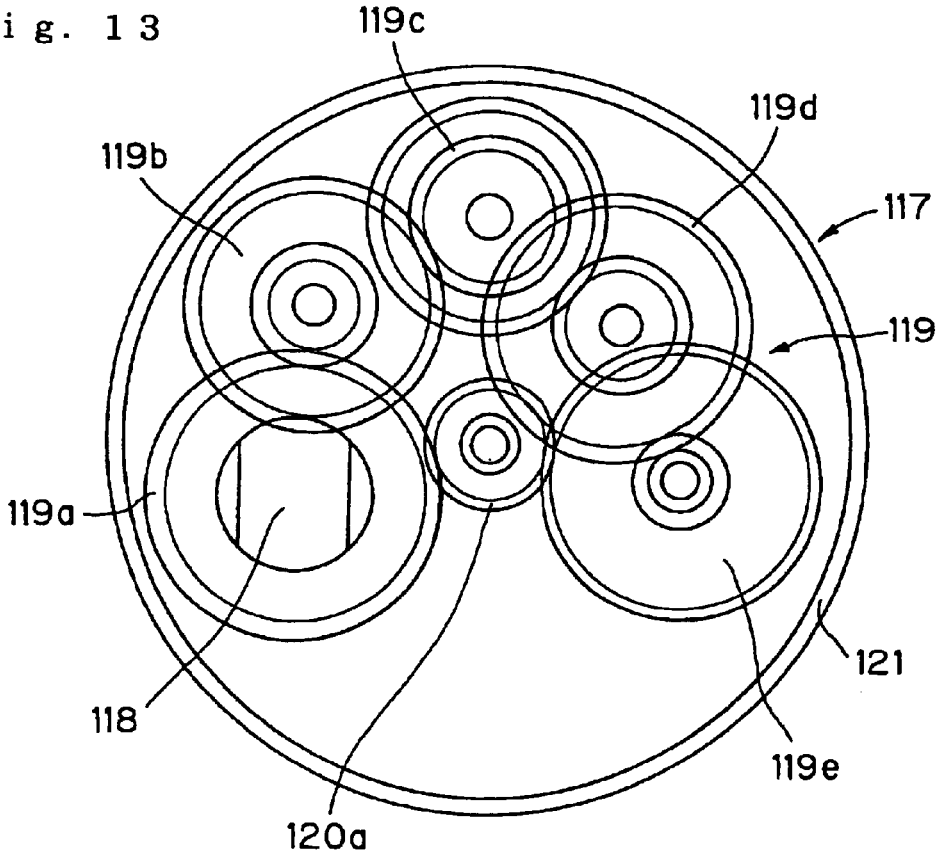
FIG. 13 is a sectional view of an accelerator provided for the mechanical timer of FIG. 12.

As shown in FIGS. 12 and 13, the mechanical timer 117 is provided with a shaft 118 directly connected to the fourth gear 116, an accelerating device 119 provided with five gears 119*a*, 119*b*, 119*c* 119*d* and 119*e* meshing with each other and operatively engaging the shaft 118, and a generating device 120 operatively engaging the accelerating device 119 through a gear 120*a* meshing with the gear 119*e*. The generating device 120 is provided with a rotor 120*b* directly connected to the gear 120*a*, a permanent magnet 120*c* fitting on the rotor 120*b* to rotate integrally with the rotor 120*b*, yokes 120*d* and 120*e* enclosing the permanent magnet 120*c*, and coils 120*f* and 120*g* wound around the yokes 120*d* and 120*e*. Ends of the coils 120*f* and 120*g* are connected to current consumers R1 and R2 through terminals not shown in Figures.

The accelerating device 119 and the generating device 120 are received in a case 121. The shaft 118 is supported by a bearing 122 connected to the case 121 at its portion passing through the case 121. The case 121 is provided with a plurality of small holes 121*a* at its portion opposite the portion to which the bearing 122 is connected.

The flush toilet in accordance with the present preferred embodiment has the same structure as the flush toilet in accordance with the first preferred embodiment except that it has the valve controller 105 instead of the valve controller 5.

Operation of the flush toilet in accordance with the present preferred embodiment will be described.

Before the start of flushing the toilet body, the members of the valve controller 105 are at their start points and their relative positions are as shown in FIGS. 6 to 11. The switching valve 2 and the selector valve 3 are closed.

A user pushes the control lever 106 to rotate it clockwise in FIG. 6, thereby starting the flushing of the toilet body. The first cam 108 rotates clockwise in FIGS. 6 and 8. As seen from FIG. 8, the cam surface 108*a* pushes up the cam rod 14 gradually to open the switching valve 2 engaging the cam rod 14 gradually. Thus, rim discharging of the wash water starts. The second gear 109 meshing with the first gear 107 rotates anticlockwise in FIG. 6 to twist the helical coil spring 111, thereby supplying it with strain energy. The clutch projection 110*a* rotates anticlockwise in FIG. 6 to move to the left in FIG. 9. The round fore end 110*a*' of the clutch projection 110*a* moves toward the fore end 110*b*' of the clutch projection 110*b*, while abutting the gentle slope of the clutch projection 110*b*. The clutch projection 110*b* does not rotate anticlockwise and the second cam 113 does not rotate anticlockwise because the frictional force working in the abutting point between the clutch projection 110*a* and the clutch projection 110*b* is very small. Therefore, the second cam 113 and the third cam 115 are held in the start points to be kept in the positions shown in FIGS. 6, 7, 10 and 11.

When the control lever 106 rotates clockwise by 180 degrees, it abuts the stopper 112 to stop rotating. Thus, the outward movement of the first cam 108 is finished and the manipulation for starting the flushing of the toilet body is finished. When the manipulation for starting the flushing of the toilet body is finished, the clutch projection 110*a* has already finished going up the slope of the clutch projection 110*b* and opposes the next clutch projection 110*b*. Therefore, the clutch projections 110*a* and 110*b* are in the same relative position as shown in FIG. 9. The perpendicularly concaving rear end 110*a* " of the clutch projection 110*a* opposes the perpendicularly concaving fore end 110*b*' of the clutch projection 110*b*. The cam rod 14 is pushed up by the first cam 108 to the maximum level. The cam rod 14 pushed up by the first cam 108 leaves the second cam surface 113*b* of the second cam 113 to leave the rectangular cutout formed in the first cam surface 113*a* outwardly in the radial direction.

When the user detaches his or her hand from the control lever 106, the helical coil spring 111 releases the accumulated strain energy to rotate the second gear 109 and the clutch projection 110*a* clockwise in FIG. 6. The first gear 107 rotates anticlockwise and the first cam 108 rotates anticlockwise to the position shown in FIG. 8. The first cam 108 starts the homeward movement. The cam rod 14 pushed up by the first cam 108 gradually comes down. The clutch projection 110*a* moves to the right in FIG. 9. The rear end 110*a* " of the clutch projection 110*a* abuts the fore end 110*b*" of the clutch projection 110*b* to drive the clutch projection 110*b* to the right. Thus, the second cam 113 rotates clockwise in FIG. 6. The second cam 113 can rotate without difficulty because the cam rod 14 leaves the rectangular cutout formed in the cam surface 113*a* of the second cam 113 outwardly in the radial direction. As seen from FIGS. 6 and 8, the first cam 108 continues the anticlockwise rotation, the second cam 113 continues the clockwise rotation, and the cam rod 14 pushed up by the first cam 108 continues to come down gradually to leave the cam surface 108*a* of the first cam 108, thereby abutting the first cam surface 113*a* of the second cam 113.

Thus, the cam rod 14 is kept at a constant level, the switching valve 2 is kept open, and the rim discharging of the wash water is continued. The third cam 115 rotates clockwise in FIGS. 6 and 11 as the second cam 113 rotates clockwise. As seen from FIG. 11, the third cam 115 continues to rotate clockwise and the second cam surface 115*b* abuts the cam rod 15 instead of the first cam surface 115*a* to push up the cam rod 15 gradually, thereby opening the selector valve 3 engaging the cam rod 15 gradually. Thus, the jet discharging of the wash water starts. The jet discharging of the wash water promptly causes a siphon phenomenon in the trap discharging passage of the toilet body 4 to promptly discharge sewage and soil from the toilet body 4.

The helical coil spring 111 continues to release the strain energy, the third cam 115 continues to rotate clockwise, the highest point of the second cam surface 115*b* passes by the cam rod 15, and the step 15*a* of the cam rod 15 opposes the perpendicular connection 115*c* between the second cam surface 115*b* and the first cam surface 115*a*. Thus, the step 15*a* comes to be able to move along the connection 115*c*. The cam rod 16 promptly falls down to the first cam surface 115*a*, the cam rod 15 pushed up by the cam 115 promptly comes down, and the selector valve 3 engaging the cam rod 15 promptly closes under the upstream water pressure. The jet discharging of the wash water stops as the selector valve 3 closes. The cam rod 14 continues to abut the first cam surface 113*a* of the second cam 113 to keep the switching valve 2 opening. Therefore, the rim discharging of the wash water continues to form water seal in the toilet body 4.

The helical coil spring 111 continues to release the strain energy, the second cam 113 rotates clockwise by 180 degrees, and the rectangular cutout formed in the first cam surface 113*a* opposes the cam rod 14. The cam rod 14 is forced by a spring not shown in Figures to promptly fall down to the second cam surface 113*b*, the cam rod 14 pushed up by the cam 113 promptly comes down, and switching valve 2 engaging the cam rod 14 promptly closes under the upstream water pressure. Thus, the homeward movement of the first cam 108 finishes. The rim discharging of the wash water stops as the switching valve 2 closes, and the flushing of the toilet body finishes. When the flushing of the toilet body finishes, the members of the valve controller 105 return to the start points and return to the relative position shown in FIGS. 6 to 11.

The first cam 108 for opening the switching valve 2 in its outward movement, the second cam 113 for closing the switching valve 2 in the homeward movement of the first cam 108 and the third cam 115 for switching the selector valve 3 in the homeward movement of the first cam 108 have different shapes. Therefore, the manner of discharging the wash water is optimized and the flushing of the toilet body becomes efficient.

The first cam 108 gradually opens the switching valve 2 exposed to high water pressure to reduce the force necessary for opening the switching valve 2.

The second cam 113 promptly closes the switching valve 2 to reduce the time necessary for flushing the toilet body.

The third cam 115 gradually opens the selector valve 3 to reduce the force necessary for opening the selector valve 3, thereby downsizing the helical coil spring 111. The third cam 116 promptly closes the selector valve 3 to reduce the time necessary for flushing the toilet body.

The switching valve 2 is opened by manually rotating the control lever 106 because a large force is necessary to open the switching valve 2.

Therefore, the helical coil spring 111 only need to switch the selector valve 3 and close the switching valve 2. No large force is necessary to switch the selector valve 3 and close the switching valve 2. Thus, the helical coil spring 111 is downsized. The operation for supplying the helical coil spring 111 with the strain energy and the operation for opening the switching valve 2 are carried out by rotating the control lever 106. Thus, number of the elements becomes smaller than that in the case where the aforementioned two operations are carried out with independent devices.

The stopper 112 regulates the angle of rotation of the control lever 106 to accurately control the amount of the strain energy accumulated in the helical coil spring 111, thereby accurately controlling the duration of the operation of the helical coil spring 111. Thus, the timings of switching the switching valve 2 and the selector valve 3 are controlled accurately, the timing of discharging the wash water is controlled accurately, and the quantity of the discharging wash water is controlled accurately.

The switching of the selector valve 3 by the third cam 115 in the outward movement of the first cam 108 and the switching of the selector valve 3 by the third cam 115 in the homeward movement of the first cam 108 are asymmetrical to each other. Thus, the relation between the timing of the rim discharging of the wash water and the timing of the jet discharging of the wash water is optimized, the jet discharging of the wash water is started after the rim discharging of the wash water has continued for a predetermined period and the surface of the water seal in the bowl of the toilet body has risen to a sufficient level, the siphon phenomenon is promptly generated in the trap discharging passage, and the wash water necessary for flushing the toilet body is saved.

When the helical coil spring 111 releases the accumulated strain energy to rotate the second cam 113, the third gear 114 directly connected to the second cam 113 rotates, and the fourth gear 116 meshing with the third gear 114 rotates. The shaft 118 of the mechanical timer 117 directly connected to the fourth gear 116 rotates. The rotation of the shaft 118 is accelerated by the accelerating device 119 operatively engaging the shaft 118 to be transmitted to the rotor 120*b* of the generating device 120, thereby rotating the rotor 120*b* and the permanent magnet 120*c* at a large velocity to generate electromotive forces in the coils 120*f* and 120*g*. The electric power generated by the generating device 120 is consumed by the current consumers R1 and R2 connected to the generating device 120. When the mechanical timer 117 consumes a part of the strain energy released from the helical coil spring 111 as electric power, the electric currents flowing in the coils 120*f* and 120*g* generate magnetic fields. The magnetic fields form resistance against the rotation of the permanent magnet 120*c* and the rotations of the second cam 113 and the third cam 115. Thus, the mechanical timer 117 regulates the rotation velocities of the second cam 113 and the third cam 115, regulates the times necessary for the second cam 113 and the third cam 115 to rotate by 180 degrees, and regulates the duration of driving the second cam 113 and the third cam 115 by the helical coil spring 111 or the duration of the operation of the helical coil spring 111.

The mechanical timer 117 makes it possible to flush the toilet body even at an electric service interruption.

The electromotive voltage of the generating device 120 fluctuates and the electric power consumption of the mechanical timer 117 fluctuates as the rotation velocity of the shaft 118 fluctuates. The electric currents flowing in the coils 120*f* and 120*g* fluctuate, the resistance against the rotations of the permanent magnet 120*c* and the shaft 118 fluctuates as the electric power consumption of the mechanical timer 117 fluctuates. Therefore, the rotation velocity of the shaft 118 is kept constant, the rotation velocities of the second cam 113 and the third cam 115 are kept constant, and the timings of switching the selector valve 3 and closing the switching valve 2 are kept constant even if the spring constant of the helical coil spring 111 differs a little from the specified value and the driving force applied to the shaft 118 from the helical coil spring 111 differs a little from the specified value.

It is possible to adjust the values of the current consumers R1 and R2 connected to the generating device 120 so as to adjust the electric power consumption of the mechanical timer 117, adjust the rotation velocities of the second cam 113 and the third cam 115, adjust the duration of operation of the helical coil spring 111, adjust the duration of discharging the wash water, and adjust the quantity of the wash water necessary for flushing the toilet body. The quantity of the wash water necessary for flushing the toilet body can therefore be adjusted easily because the values of the current consumers R1 and R2 can be adjusted easily.

The bearing 122 disposed midway of the shaft 118 prevents liquid such as dew drops, etc. from reaching the accelerating device 119 and the generating device 120 through the shaft 118 and adhering to them. Thus, the accelerating device 119 and the generating device 120 are prevented from malfunctioning and other problems.

The bearing 122 is connected to and firmly supported by the case 121 for receiving the accelerating device 119 and the generating device 120. Therefore, the bearing 122 can display an excellent sealing function.

The accelerating device 119 and the generating device 120 are received in the case 121. Therefore, they are prevented from damage by external forces. Liquid such as dew drops, etc. cannot adhere to the accelerating device 119 and the generating device 120 received in the case 121. Thus, the accelerating device 119 and the generating device 120 are prevented from malfunctioning and other problems.

Heat generated by the accelerating device 119 and the generating device 120 is discharged from the case 121 through the plurality of small openings 121*a* formed in the case 120. Therefore, the accelerating device 119 and the generating device 120 are prevented from malfunctioning and other problems due to overheating.

The present invention is not limited to the aforementioned preferred embodiments.

In the first embodiment, a pilot operated switching valve and a pilot operated selector valve may be provided instead of the switching valve 2 and the selector valve 3. When a pilot operated switching valve and a pilot operated selector valve are used, forces necessary for switching the switching valve and the selector valve decrease, the valve controller is downsized, and the force necessary for manipulating the start button C decreases. The pilot operated switching valve and the pilot operated selector valve will be described in detail.

Figure 14:
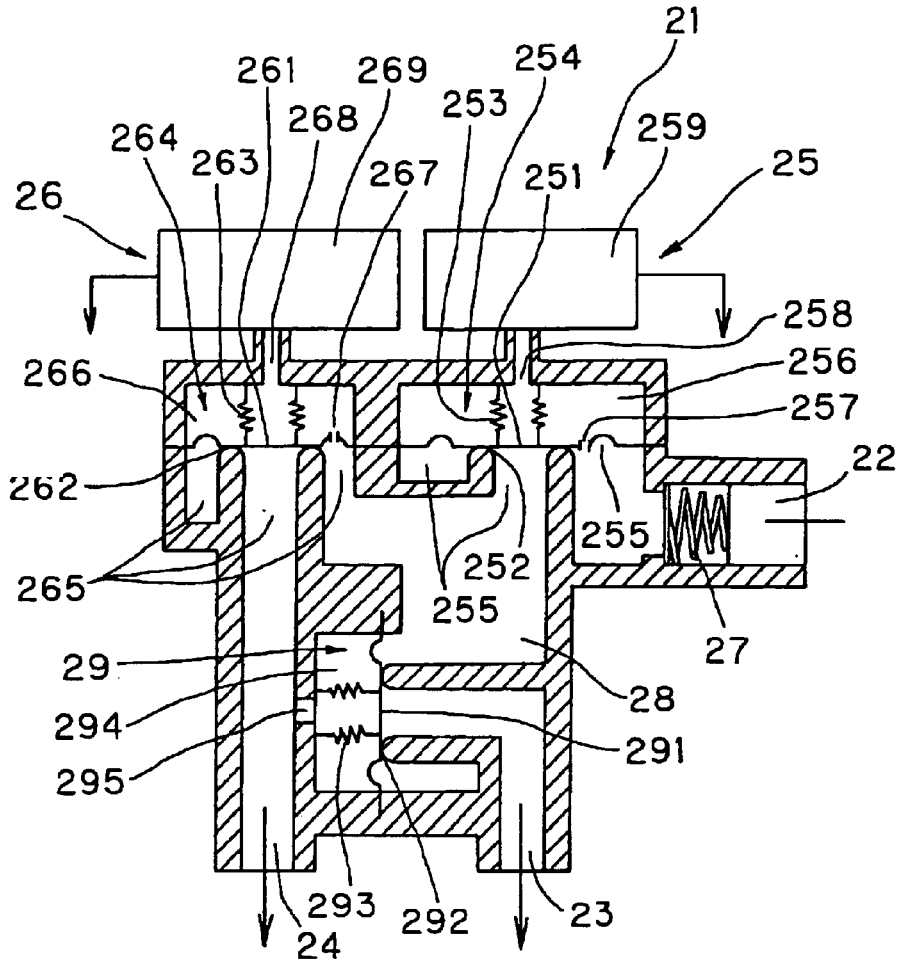
FIG. 14 is a set of sectional views of a pilot-operated switching valve and a pilot-operated selector valve.

As shown in FIG. 14, a pilot operated valve device 21 is provided with an inlet port 22 for wash water, an outlet port 23 for wash water for rim discharge, an outlet port 24 for the wash water for jet discharge, a switching valve device 25 and a selector valve device 26. The inlet port 22 is connected to a water service pipe for domestic use. The outlet port 23 is connected to the rim discharge holes 4*a* through the pipe 1. The outlet port 24 is connected to the jet discharge nozzle 4*b* through the pipe 1*a*.

The switching valve device 25 is provided with a diaphragm valve 254 structured by a diaphragm 251, a valve seat 252 and a biasing spring 253, and a wash water passage 255 switched by the diaphragm valve 254. The wash water passage 255 upstream of the diaphragm valve 254 communicates with the inlet port 22 through a flow regulating valve 27. The wash water passage 255 downstream of the diaphragm valve 264 communicates with a chamber 28.

The switching valve device 26 is provided with a pressure chamber 256. The diaphragm 251 forms a part of the enclosure of the pressure chamber 256.

The diaphragm 251 is provided with a pilot inlet passage 257 communicating with the pressure chamber 256. A pilot outlet passage 258 extends from the pressure chamber 256.

A pilot valve 259 is provided for switching the pilot outlet passage 258. The pilot valve 259 is provided with a valve body and a coil spring for forcing the valve body to close the pilot outlet passage 258.

The valve body and the coil spring are not shown in Figures. The cam rod 14 is fixed to the valve body. The cam rod 14 is driven by the valve controller 5 shown in FIG. 2.

The selector valve device 26 is provided with a diaphragm valve 264 structured by a diaphragm 261, a valve seat 262 and a biasing spring 263, and a wash water passage 265 switched by the diaphragm valve 264. The wash water passage 266 upstream of the diaphragm valve 264 communicates with a chamber 28. The wash water passage 265 downstream of the diaphragm valve 264 communicates with the outlet port 24.

The selector valve device 26 is provided with a pressure chamber 266. The diaphragm 261 forms a part of the enclosure of the pressure chamber 266.

The diaphragm 261 is provided with a pilot inlet passage 267 communicating with the pressure chamber 266. A pilot outlet passage 268 extends from the pressure chamber 266. A pilot valve 269 is provided for switching the pilot outlet passage 268. The pilot valve 269 is provided with a valve body and a coil spring for forcing the valve body to close the pilot outlet passage 268.

The valve body and the coil spring are not shown in Figures. The cam rod 15 is fixed to the valve body. The cam rod 15 is driven by the valve controller 5 shown in FIG. 2.

A diaphragm valve 29 is disposed between the chamber 28 and the outlet port 23. The diaphragm valve 29 is structured by a diaphragm 291, a valve seat 292 and a biasing spring 293. A pressure chamber 294 is provided. The diaphragm 291 forms a part of the enclosure of the pressure chamber 294.

The pressure chamber 294 communicates with a passage between the wash water passage 265 downstream of the diaphragm valve 264 and the outlet port 24 through a communicating hole 295.

Operation of the pilot operated valve device 21 will be described.

When the valve controller 5 shown in FIG. 2 is in the initial condition, the valve body of the pilot valve 259 is forced by the coil spring in the direction for closing the pilot outlet passage 258 and the pilot valve 259 closes the pilot outlet passage 258. Thus, the wash water is prevented from entering into the pressure chamber 256. The upstream pressure of the diaphragm valve 254 is substantially the same as that in the pressure chamber 256 due to the pilot inlet passage 257. The force applied to the diaphragm 261 by the pressure in the pressure chamber 256 is larger than that by the pressure in the wash water passage 255 because the downstream pressure of the diaphragm valve 254 is lower than the upstream pressure of the diaphragm valve 254. The diaphragm 251 is forced by the spring 253.

Therefore, the diaphragm 251 is forced against the valve seat 252, the diaphragm valve 254 or the switching valve device 25 closes the wash water passage 255, and the wash water is not discharged from the rim discharge holes 4*a* or the jet discharge nozzle 4*b* of the toilet body 4.

When the valve controller 5 shown in FIG. 2 is in the initial condition, the valve body of the pilot valve 269 is forced by the coil spring in the direction for closing the pilot outlet passage 268 and the pilot valve 269 closes the pilot outlet passage 268. Thus, the wash water is prevented from entering into the pressure chamber 266. The diaphragm valve 264 or the selector valve device 26 closes the wash water passage 265 in the same way as the switching valve device 25.

When the valve controller 5 shown in FIG. 2 is in the initial condition, the diaphragm 291 abuts the valve seat 292 under the biasing force of the spring 293. Thus, the diaphragm valve 29 intercepts the communication between the chamber 28 and the outlet port 23.

Figure 15:
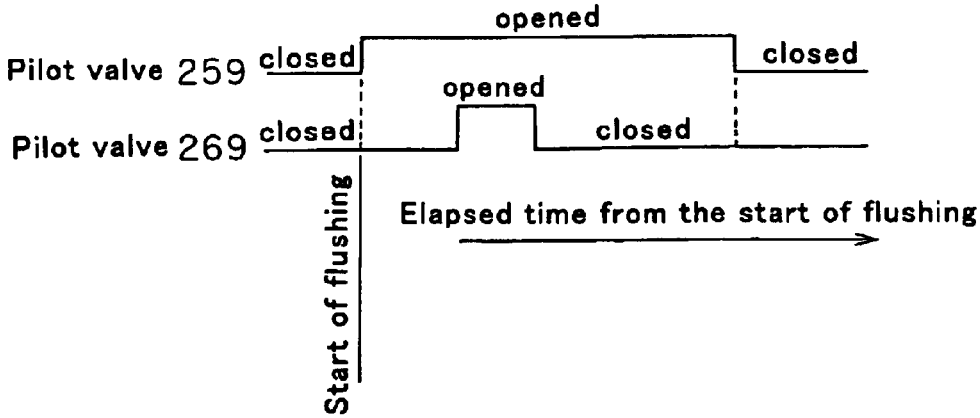
FIG. 15 is a set of time charts of the switching operations of pilot valves of the pilot-operated switching valve and the pilot-operated selector valve.

A user manipulates the start button C of the valve controller 5 to start flushing the toilet body. In the outward movement of the valve switching device B, the cam 11*a* of the valve switching device B engages the cam rod 14 to drive it in the direction for opening the valve, thereby driving the valve body of the pilot valve 259 of the switching valve device 25 in the direction for opening the pilot outlet passage 258 against the biasing force of the coil spring. Thus, the pilot valve 259 opens the pilot outlet passage 258 as shown in FIG. 15. When the pilot outlet passage 258 opens, the wash water flows into the pressure chamber 256 through the pilot inlet passage 257 and flows out the pressure chamber 256 through the pilot outlet passage 258. The pressure in the pressure chamber 256 becomes lower than the upstream pressure of the diaphragm valve 254 due to the pressure loss generated when the wash water passes through the pilot inlet passage 257. The forces acting on the diaphragm 251 are thrown out of balance and the diaphragm 251 leaves the valve seat 252 to move toward the pressure chamber 256. Thus, the diaphragm valve 254 or the switching valve device 25 opens the wash water passage 255.

The wash water passes through the inlet port 22. The flow rate of the wash water is adjusted to a predetermined value Q by the flow regulating valve 27. The wash water flows into the chamber 28 through the wash water passage 255. The pressure in the chamber 28 increases, the forces acting on the diaphragm 291 are thrown out of balance, and the diaphragm 291 leaves the valve seat 292 to move toward the pressure chamber 294. Thus, the diaphragm valve 29 communicates the chamber 28 with the outlet port 23.

Figure 16:
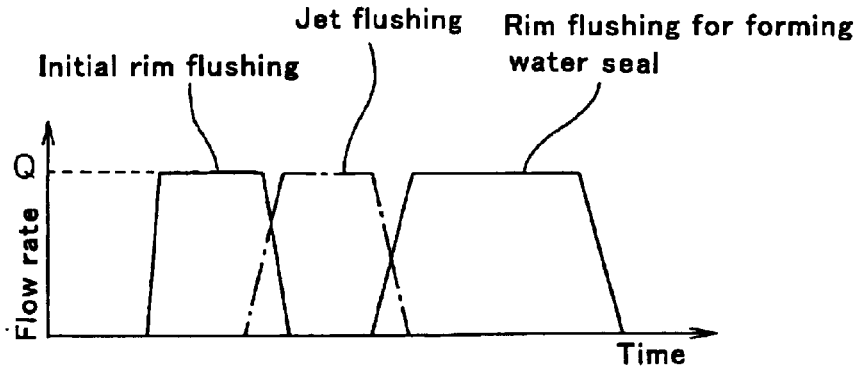
FIG. 16 is a diagram showing a pattern of discharging the wash water when the pilot-operated switching valve and the pilot-operated selector valve are used.

When the chamber 28 communicates with the outlet port 23, the wash water discharges from the outlet port 23. The wash water with the flow rate of Q discharging from the outlet port 23 passes through the pipe 1 to discharge from the rim discharge holes 4*a* of the toilet body 4. Thus, an initial rim flushing is carried out as shown in FIG. 16.

The diaphragm valve 264 of the selector valve device 26 closes the wash water passage 265 because the pilot valve 269 closes the pilot outlet passage 268. Thus, the chamber 28 does not communicate with the outlet port 24 and the wash water does not discharge from the jet discharge nozzle 4*b*.

In the homeward movement of the valve switching device B, the cam 11*c* of the valve switching device B engages the cam rod 15 through the cam engaging member 13 to drive the cam rod 15 in the direction for opening the valve, thereby driving the valve body of the pilot valve 269 of the selector valve device 26 in the direction for opening the pilot outlet passage 268 against the biasing force of the coil spring. Thus, the pilot valve 269 opens the pilot outlet passage 268 as shown in FIG. 15. When the pilot outlet passage 268 opens, the wash water flows into the pressure chamber 266 through the pilot inlet passage 267 and flows out the pressure chamber 266 through the pilot outlet passage 268. The pressure in the pressure chamber 266 becomes lower than the upstream pressure of the diaphragm valve 264 due to the pressure loss generated when the wash water passes through the pilot inlet passage 267. The forces acting on the diaphragm 261 are thrown out of balance and the diaphragm 261 leaves the valve seat 262 to move toward the pressure chamber 266. Thus, the diaphragm valve 264 or the selector valve device 26 opens the wash water passage 265.

The wash water flows into the wash water passage 265 from the chamber 28 and discharges from the outlet port 24. The wash water with the flow rate of Q discharging from the outlet port 24 passes through the pipe 1*a* to discharge from the jet discharge nozzle 4*b* of the toilet body 4. Thus, a jet flushing is carried out as shown in FIG. 16. A siphon phenomenon is generated in the trap discharging passage of the toilet body 4 and the sewage is discharged from the toilet body 4.

A part of the wash water passing through the communication passage between the wash water passage 265 and the outlet port 24 enters into the pressure chamber 294. Thus, the pressure in the pressure chamber 294 increases, the forces acting on the diaphragm 291 are thrown out of balance, and the diaphragm 291 is forced against the valve seat 292. Thus, the diaphragm valve 29 intercepts the communication between the chamber 28 and the outlet port 23. Therefore, the wash water does not discharge from the rim discharge holes 4*a* and the rim flushing is not carried out.

In the homeward movement of the valve switching device B, the engagement between the cam 11*c* of the valve switching device B and the cam rod 15 through the cam engaging member 13 is released and the valve body of the pilot valve 269 moves in the direction for closing the pilot outlet passage 268 under the biasing force of the coil spring. Thus, the pilot valve 269 closes the pilot outlet passage 268. The diaphragm valve 264 or the selector valve device 26 closes the wash water passage 265. The wash water stops discharging from the outlet port 24 and the jet discharge nozzle 4*b*, and the jet flushing is finished. The wash water stops flowing in the communicating passage between the wash water passage 265 and the outlet port 24, the wash water flows out of the pressure chamber 294 to decrease the pressure in the pressure chamber 294, forces acting on the diaphragm 291 are thrown out of balance, the diaphragm 291 leaves the valve seat 292 to move toward the pressure chamber 294, and the diaphragm valve 29 communicates the chamber 28 with the outlet port 23. The wash water discharges from the outlet port 23. The wash water with the flow rate of Q discharging from the outlet port 23 carries out a rim flushing for forming water seal as shown in FIG. 16. Thus, water seal is formed in the bowl of the toilet body 4.

In the homeward movement of the valve switching device B, the engagement between the cam 11*a* of the valve switching device B and the cam rod 14 is released, the valve body of the pilot valve 259 moves in the direction for closing the valve under the biasing force of the coil spring, and the pilot valve 259 closes the pilot outlet passage 258. The diaphragm valve 254 or the switching valve device 25 closes the wash water passage 256. Thus, the wash water stops discharging from the pilot operated valve device 21, the rim flushing for forming water seal is finished as shown in FIG. 16, and the flushing of the toilet body is finished.

In the pilot operated valve device 21, the pilot valves 259 and 269 are switched so that the switching valve device 25 switches the wash water passage and the selector valve device 26 selects one from a plurality of wash water passages. The pilot outlet passages 258 and 268 operate even if their diameters are small. Therefore, small valves needing only small forces for driving them can be used as the pilot valves 259 and 269. Therefore, the forces applied to the cam rods 14 and 15 can be reduced and the valve controller 5 can be downsized. The force necessary for manipulating the start button C also can be reduced.

The flow regulating valve 27 prevents fluctuation of the flow rate of the discharging wash water due to fluctuation of the pressure of the wash water supplied from the domestic water supply pie. Therefore, a stable flushing of the toilet body can be achieved.

A flow control valve may be used instead of the flow regulating valve 27. The flow rate of the discharging wash water can be controlled depending on the toilet body specifications and the quantity of the wash water used for flushing the toilet body can be optimized.

The pilot operated valve device 21 may be driven with the valve controller 105.

Figure 17:
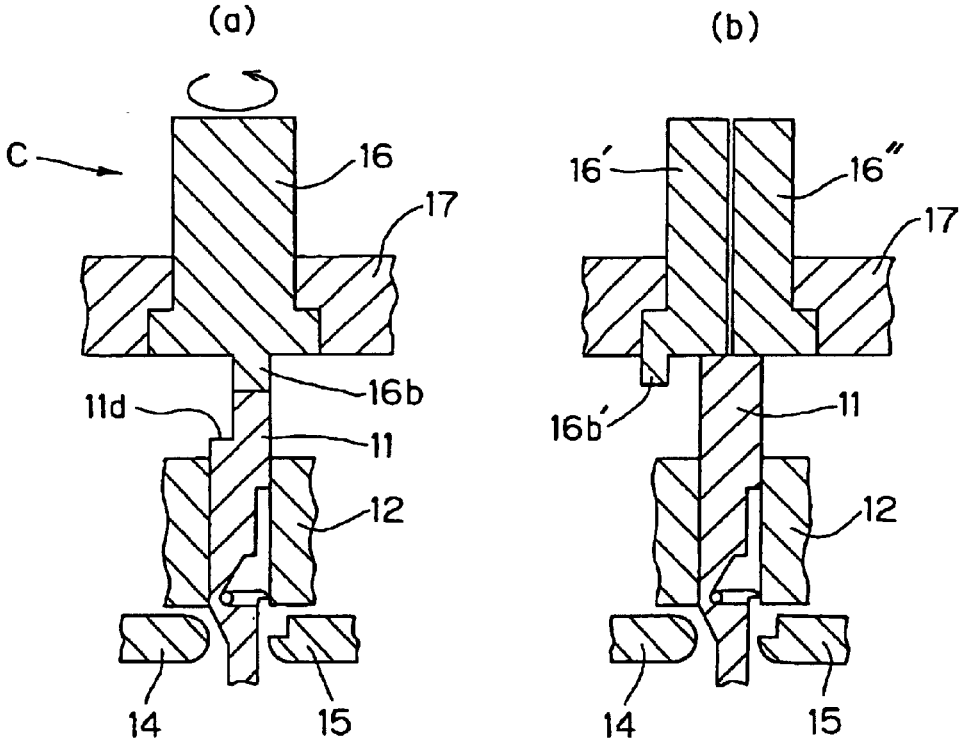
FIG. 17 is a set of sectional views of the valve switching device and a start button showing a mechanism for controlling the stroke of the reciprocal movement of the valve switching device.

It is possible, as shown in FIG. 17(*a*), to provide the button body 16 of the start button C with a projection 16*b*, engage the button body 16 with the guide member 17 to rotate around a longitudinal axis of the button body 16, and provide the spindle 11 with a step 11*d* at its one end. When the valve controller 5 is in the initial condition, the button body 16 of the start button C abuts the said one end of the spindle 11 at the projection 16*b* within a predetermined rotational region of the button body 16, but outside the predetermined rotational region, the button body 16 is distanced from the said one end of the spindle 11. Thus, the stroke of the outward movement of the spindle 11 in the case where the button body 16 is rotated to a predetermined rotational point and pushed in the guide member 17 becomes different from the stroke of the outward movement of the spindle 11 in the case where the button body 16 is pushed in the guide member 17 without being rotated to the predetermined rotational point. Thus, the quantity of the discharging wash water in the case where the button body 16 is rotated to a predetermined rotational point and pushed in the guide member 17 becomes different from the quantity of the discharging wash water in the case where the button body 16 is pushed in the guide member 17 without being rotated to the predetermined rotational point. Thus, the quantity of the discharging wash water in flushing the toilet body after defecation can be made different from the quantity of the discharging wash water in flushing the toilet body after urination with a simple device, and wash water used for flushing the toilet body can be saved.

It is possible, as shown in FIG. 17(*b*), to divide the button body 16 of the start button C into half portions 16' and 16", and provide the half portion 16' with a projection 16*b*'. In this case, the stroke of the movement of the half portion 16' when the half portion 16' is pushed in the guide member 17 becomes different from the stroke of the movement of the half portion 16" when the half portion 16" is pushed in the guide member 17, the stroke of the outward movement of the spindle 11 when the half portion 16' is pushed in the guide member 17 becomes different from the stroke of the outward movement of the spindle 11 when the half portion 16" is pushed in 10 the guide member 17. Thus, the quantity of the discharging wash water when the half portion 16' is pushed in the guide member 17 becomes different from the quantity of the discharging wash water when the half portion 16" is pushed in the guide member 17. Thus, the quantity of the discharging wash water in flushing the toilet body after defecation can be made different from the quantity of the discharging wash water in flushing the toilet body after urination with a simple device and, wash water used for flushing the toilet body can be saved. The quantity of the discharging wash water in flushing the toilet body after defecation can be made different from the quantity of the discharging wash water in flushing the toilet body after urination only by manipulating the desirable half portion 16' or 16". Thus, the flush toilet becomes more convenient.

The cam 11*a* of the valve switching device B is desirably provided with a shape that makes the component of the force applied to the cam rod 14 by the cam 11*a* in the direction for driving the switching valve 2 larger than that in the direction at right angles to said direction. More concretely, the slope $11a_1$ is desirably made gentle. When the cam 11*a* is provided with such a shape, the force necessary for switching the switching valve 2 decreases and the valve controller 5 is downsized.

In the valve controller 5, it is possible to regulate the flow rate of the air discharging from the chamber a instead of regulating the flow rate of the air entering into the chamber B, thereby regulating the volume increasing rate of the chamber B and regulating the moving velocity of the spindle 11 in its homeward movement.

In the valve controller 105, it is possible to use variable resistors for the current consumers R1 and R2 and to manipulate the control levers of the variable resistors so as to adjust the value of the current consumers R1 and R2, adjust the duration of the operation of the helical coil spring 111, and adjust the quantity of the wash water for flushing the toilet body. The duration of the operation of the helical coil spring 111 can be adjusted and the quantity of the discharging wash water can be adjusted even while the operation of the valve controller 106 proceeds. It is possible to dispose a plurality of current consumers with different values for each of the current consumers R1 and R2, and select a desirable one for each of the current consumers R1 and R2 with a suitable selector switch, thereby adjusting the duration of the operation of the helical coil spring 111 and adjusting the quantity of the wash water for flushing the toilet body. Thus, the quantity of the discharging wash water in flushing the toilet body after defecation can easily be made different from the quantity of the discharging wash water in flushing the toilet body after urination, and wash water used for flushing the toilet body can be saved.

Figure 18:
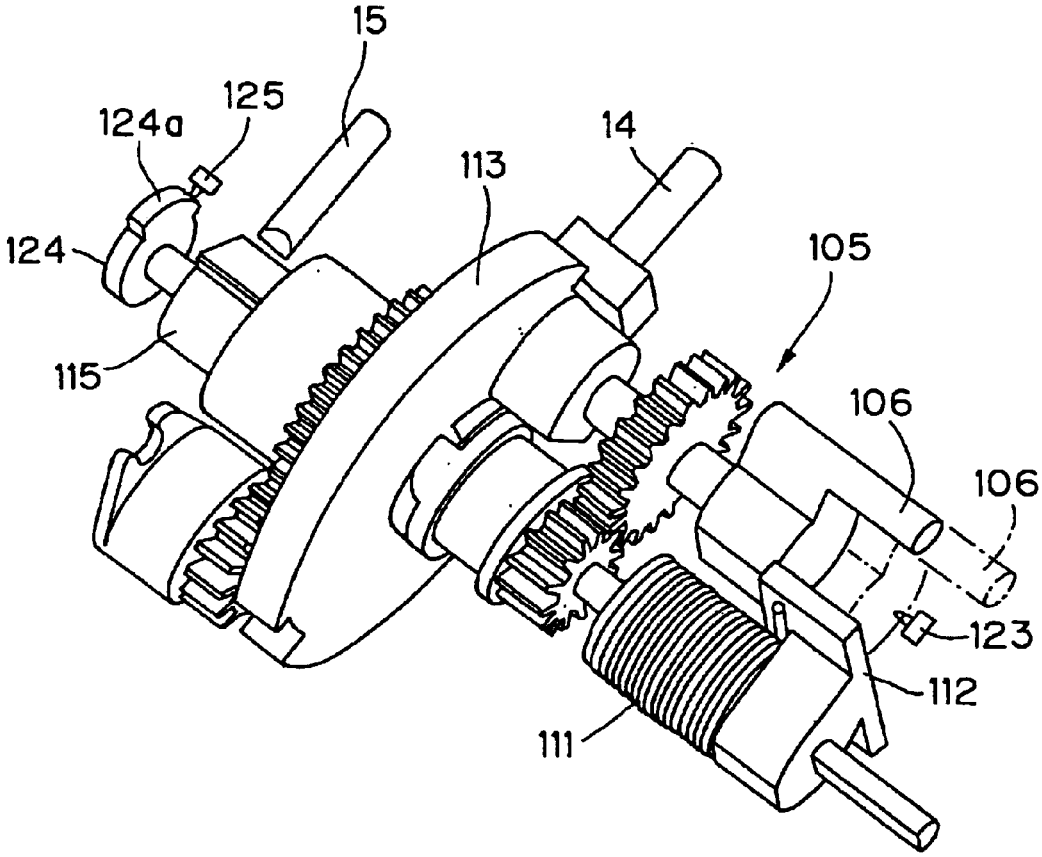
FIG. 18 is a perspective view of a variation of the valve controller provided for the flush toilet in accordance with the second preferred embodiment of the present invention.

It is possible to constitute the valve controller 105 such that the rotation velocities of the second cam 113 and the third cam 115 before the siphon phenomenon appears can be decreased to increase the quantity of the discharging wash water when the toilet body is flushed after defecation and the rotation velocities of the second cam 113 and the third cam 115 before the siphon phenomenon appears can be increased to decrease the quantity of the discharging wash water when the toilet body is flushed after urination. As shown in FIG. 18, the control lever 106 is constituted such that it can be moved manually between the first position indicated by solid lines and the second position indicated by phantom lines due to serrated connection, etc. A micro switch 123 is disposed to abut the control lever 106 in the second position, thereby being turned ON. A fourth cam 124 is directly connected to the third cam 115. A micro switch 125 is disposed close to the fourth cam 124.

Figure 19:
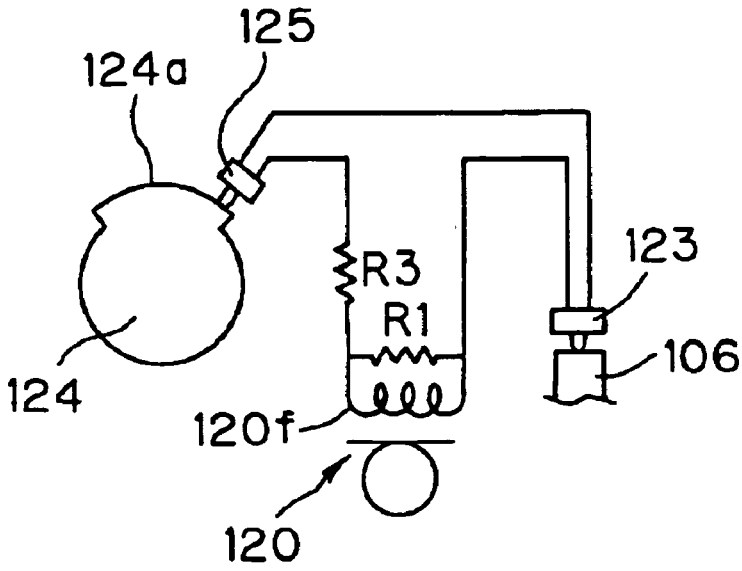
FIG. 19 is a circuit diagram of a variation of the mechanical timer provided for the flush toilet in accordance with the second preferred embodiment of the present invention.

The fourth cam 124 is provided with a cam surface 124*a* for abutting the micro switch 125, thereby turning the micro switch 125 ON during the period from a point of time just after the third cam 115 starts to rotate clockwise in FIG. 18 to a point of time when the cam rod 15 is pushed up to start the jet discharging of the wash water and generate the siphon phenomenon. As shown in FIG. 19, a current consumer R3 is disposed in parallel with the current consumer R1. The current consumer R3 is connected to the micro switches 123 and 125 in series.

When a user flushes the toilet body after defecating, he or she moves the control lever 106 to the second position to abut it against the micro switch 123, thereby turning the micro switch 123 ON. Thereafter, the user turns the control lever 106 to abut it against the stopper 112. The user then removes his or her hand from the control lever 106. The helical coil spring 111 releases the accumulated strain energy to rotate the second cam 113, the third cam 115 and the fourth cam 124 clockwise. The control lever 106 rotates anticlockwise. The abutment between the control lever 106 and the micro switch 123 is maintained. When the fourth cam 124 rotates clockwise, the cam surface 124*a* of the fourth cam 124 abuts the micro switch 125 immediately to turn it ON. Thus, the current consumer R3 is connected to the current consumer R1 in parallel. The value of the current consumer connected to the coil 120*f* of the generating device 120 decreases as the current consumer R3 is connected to the current consumer R1 in parallel and the electric power consumption of the mechanical timer 117 increases. The electric current flowing in the coil 120*f* increases, the resistance against the rotation of the permanent magnet 120*c* increases, the rotation velocity of the shaft 118 decreases, and the rotation velocities of the second cam 113 and the third cam 115 decrease. The decrease of the rotation velocities of the second cam 113 and the third cam 115 is maintained until the abutment between the cam surface 124*a* of the fourth cam 124 and the micro switch 125 is released.

Thus, the duration of discharging the wash water before the siphon phenomenon appears becomes long and quantity of discharging wash water becomes enough to flush solid sewage. The fourth cam 124 further rotates, the abutment between the cam surface 124*a* of the fourth cam 124 and the micro switch 125 is released, the micro switch 125 is turned OFF, and the current consumers R1 and R3 connected to each other in parallel are released from each other. The value of the current consumer connected to the coil 120*f* increases and the electric power consumption of the mechanical timer 117 decreases. The electric current flowing in the coil 120*f* decreases, the resistance against the rotation of the permanent magnet 120*c* decreases, rotation velocity of the shaft 118 increases, and rotation velocities of the second cam 113 and the third cam 115 increase. Thus, the jet discharging of the wash water after the appearance of the siphon phenomenon and the rim discharging of the wash water for forming the water seal are carried out in a short time.

When a user flushes the toilet body after urination, he or she moves the control lever 106 to the first position, releases the abutment between the control lever 106 and the micro switch 123, and rotates the control lever 106 to abut it against the stopper 112. The toilet body is flushed, while the current consumer R1 is connected to the coil 120*f*. Thus, the duration of discharging wash water before the appearance of the siphon phenomenon becomes shorter than that in the flushing of the toilet body after defecation and the quantity of the discharging wash water before the appearance of the siphon phenomenon becomes less than that in the flushing of the toilet body after defecation. A small quantity of wash water can flush sewage from the toilet body because no solid sewage remains in the toilet body 4.

In accordance with the aforementioned structure, a user can change the quantity of the discharging wash water easily by changing the way of manipulating the control lever 106. The manipulation for changing the quantity of the discharging wash water is simple because no manipulation of the control lever of the variable resistor and no manipulation of the selector switch for selecting a desirable current consumer is needed in addition to the manipulation of the control lever 106.

Figure 20:
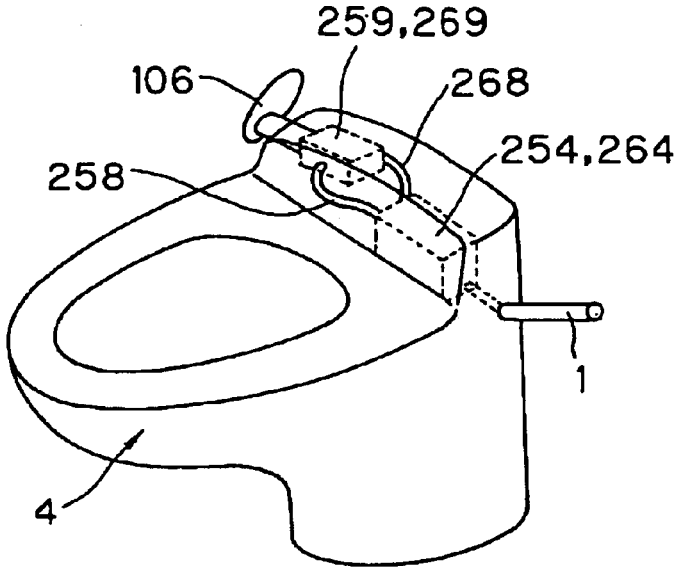
FIG. 20 is a perspective view of a flush toilet provided with a variation of the pilot-operated switching valve and the pilot-operated selector valve.
Figure 21:
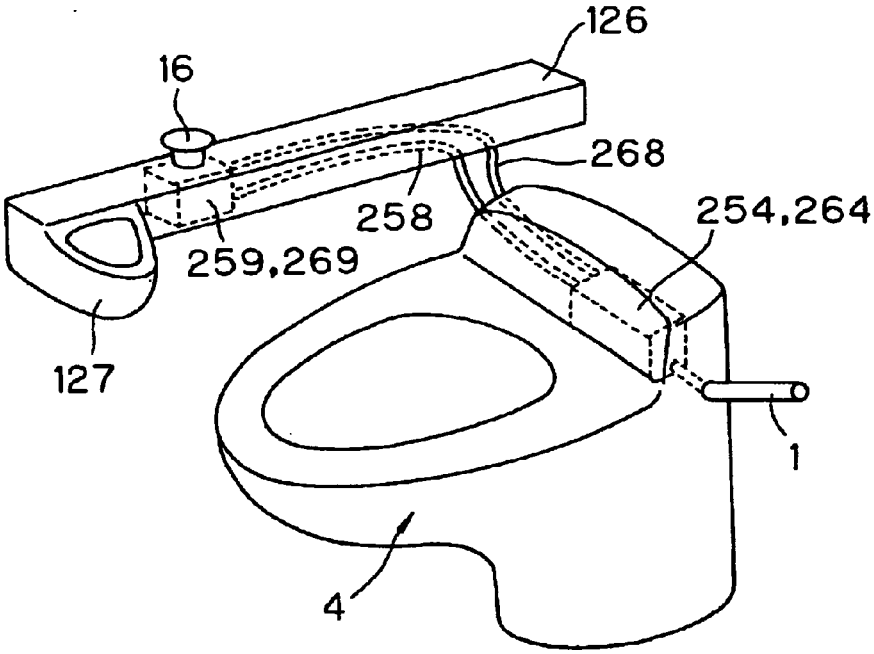
FIG. 21 is a perspective view of a flush toilet provided with a variation of the pilot-operated switching valve and the pilot-operated selector valve.

In the pilot operated valve device 21, the pilot outlet passages 258 and 268 may be made of long pipes. In this case, the pilot valves 259 and 269 can be distanced from the diaphragm valves 254 and 264 and the freedom of arranging the pilot operated valve device 21 increases. Therefore, the pilot operated valve device 21 can be set in a device receiving space of the toilet body 4 easily as shown in FIG. 20, or, as shown in FIG. 21, it becomes possible to receive the diaphragm valves 254 and 264 in the device receiving space of the toilet body 4 and dispose the pilot valves 259 and 269 and the valve controller 5 in a counter 126 for washing the hands to enhance the maneuverability of the valve controller 5. The wash water discharged from the pilot valves 259 and 269 can be led to a wash basin 127 and used as water for washing the hands.

The shapes of the cams of the valve controllers 5 and 105 for switching valves can be changed variously. Thus, the wash water can be discharged in various modes.

The valve controller 5 or 105 is, except for the start button C or the control lever 106, desirably installed in a container such as a device receiving space formed in the toilet body 4, a device receiving space formed in the counter 126 for washing the hands, or the like. This decreases the likelihood of tampering that might change the timing of the wash water discharge and/or damage the aforementioned devices.

In the valve controller 5, as indicated by phantom lines in FIG. 2(*a*), an auxiliary control lever 16' may be manipulated before starting the manipulation of the start button C to drive the cam rod 14 in the direction indicated by a void arrow, thereby opening the switching valve 2. This decreases the force necessary for manipulating the start button C. When a user removes his or her hand from the auxiliary lever 16' after finishing the manipulation of the start button C, the cam rod 14 returns automatically to a position where it abuts the spindle 11. Therefore, no trouble is caused in the operation of the valve control device 5 after finishing the manipulation of the start button C. In the valve controller 105, as indicated by phantom lines in FIG. 6, an auxiliary control lever 106' may be manipulated before starting the manipulation of the control lever 106 to drive the cam rod 14, thereby opening the switching valve 2. This decreases the force necessary for manipulating the control lever 106. When a user removes his or her hand from the auxiliary lever 106' after finishing the manipulation of the control lever 106, the cam rod 14 returns automatically to a position where it abuts the first cam 108. Therefore, no trouble is caused in the operation of the valve controller 105 after finishing the manipulation of the control lever 106.

In the valve controller 5, as indicated by phantom lines in FIG. 2(*a*), the button body 16 may be provided with a return spring 16". In this case, when a user removes his or her hand from the button body 16 after he or she finished pushing down the button body 16, the button body 16 immediately returns to the start point. In the valve controller 105, the control lever 106 may be provided with a one-way clutch and a return spring. In this case, when a user removes his or her hand from the control lever 106 after he or she rotated the control lever 106 clockwise to abut it against the stopper 112, the control lever 106 immediately returns to the start point. This makes the user feel easy because the button body 16 or the control lever 106 returns to the start point immediately after completion of the manipulation.

In the valve controller 105, it is possible to remove the first cam 108 and adjust the cam surface of the second cam 113 to let the second cam 113 and the third cam 115 switch the switching valve 2 and the selector valve 3 in their clockwise rotations corresponding to the homeward movement of the first cam 108. Thus, the switching valve 2 and the selector valve 3 are switched only by the helical coil spring 111, whose operating duration is accurately controlled by the mechanical timer 117. Therefore, the quantity of the discharging wash water is controlled accurately.

In the valve controller 105, a power spring may be disposed instead of the helical coil spring 111.

In the valve controller 5, the cam engaging member 13 may engage the cam 11*c* with the cam rod 15 in the outward movement of the spindle 11 and after the cam 11*a* engaged the cam rod 14.

Another example of the device for adjusting the value of the current consumer of the mechanical timer 117 provided for the valve controller 105 will be described.

Figure 22:
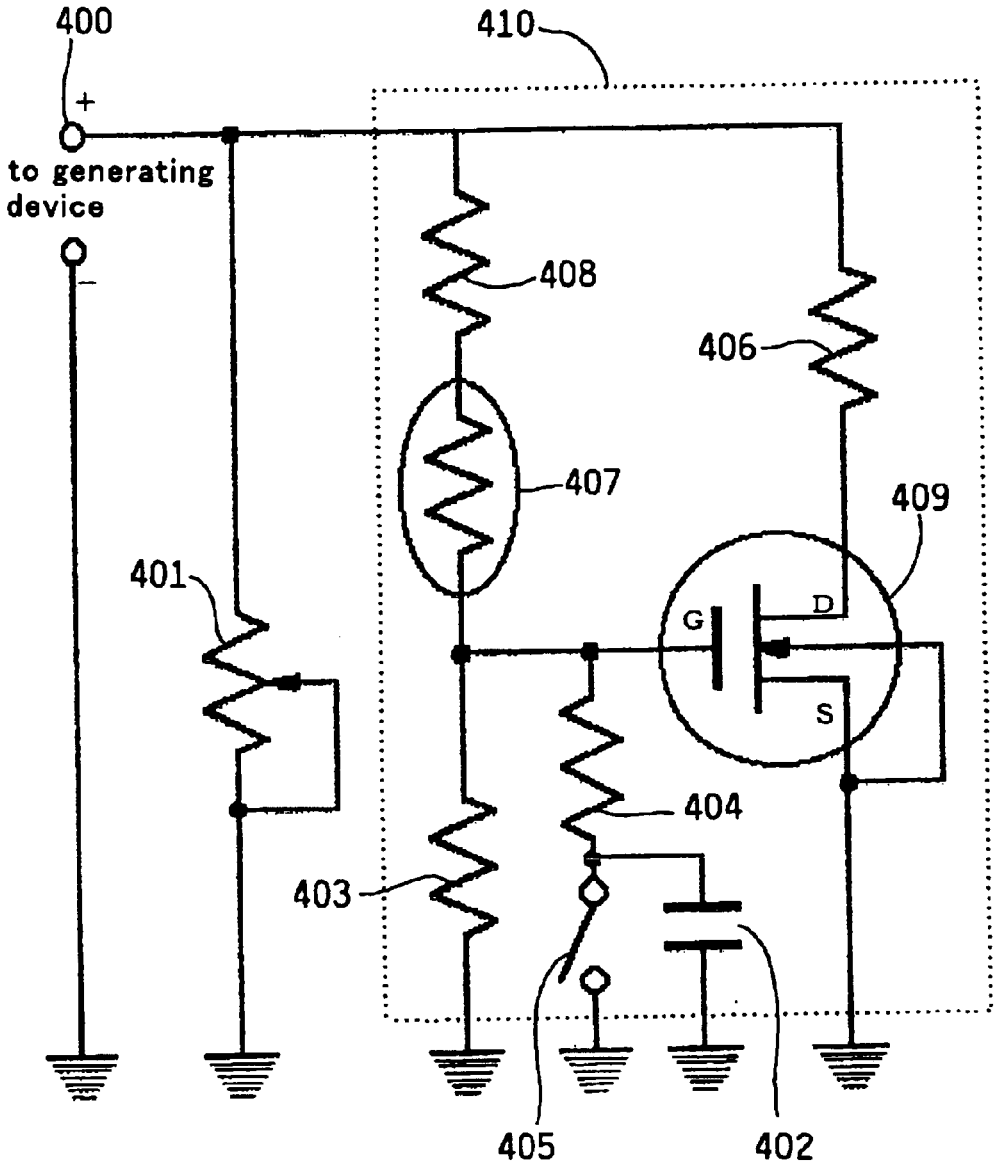
FIG. 22 is a circuit diagram of an adjuster of a current consumer provided for the mechanical timer.

As shown in FIG. 22, an output terminal of the generating device 120 is connected to an input terminal 400 to apply the electromotive force of the generating device 120 to the input terminal. A device 410 for adjusting the setting value of current consumer is provided in parallel with a current consumer 401 made of a pre-set variable resistor. The device 410 is provided with a voltage dividing circuit made of resistors 403, 407 and 408. The voltage dividing circuit is connected to an input terminal (G) of a transistor 409. The transistor 409 is a N-channel MOSFET with a depression+enhancement type characteristic adapted to control a drain (D) current depending on the value of the gate (G) voltage. It can be considered that the gate voltage is univocally determined by the ratio of the resistances of the resistors 403, 407 and 408 because the input impedance of the gate is very large and the current flowing into the gate is negligibly small. It is therefore possible to control the gate voltage so as to control the current flowing in the transistor 409 and the ON resistance between the drain (D) and source (S).

The ON resistance of the transistor 409 fluctuates or the transistor 409 is switched depending on the value of the input voltage of the transistor 409.

Thus, the setting value of current consumer of the device 410 and the value of the current flowing in the device 410 are controlled through the resistor 406 and the setting value of current consumer for the generating device 120 is controlled.

The resistor 407 is an NTC type thermistor wherein resistance decreases as the temperature rises. Therefore, the input voltage or the gate (G) voltage of the transistor 409 increases, the current flowing in the transistor 409 increases and the ON resistance decreases as the temperature rises. The internal resistances of the coils 120*f* and 120*g* of the generating device 120 increase, the currents flowing in the coils 120*f* and 120*g* decrease, and the braking force of the generating device 120 decreases as the temperature rises. The resistor 407 is a device for compensating for reduction of the braking force of the generating device 120 due to temperature rise. When the device 410 is provided with a negative characteristic with respect to fluctuations of the internal resistance of and the current flowing in the generating device 120 due to temperature rise, the braking force of the generating device 120 does not fluctuate, the rotation velocity of the shaft 118 does not fluctuate, the velocity of the homeward rotation of the first cam 108 does not fluctuate, and the rotation velocities of the second cam 113 and the third cam 115 do not fluctuate even if the temperature fluctuates.

The aforementioned device 410 has also the following advantage. When the rotation velocity of the generating device 120 changes, the output voltage of the generating device 120 changes, and the voltage applied to the input terminal 400 changes. When the rotation velocity increases, the electromotive force increases to increase the input voltage of the transistor 409. When the rotation velocity decreases, the electromotive force decreases to decrease the input voltage of the transistor 409. When the rotation velocity of the generating device 120 increases to increase the electromotive force of the generating device 120, the gate (G) voltage increases to decrease the ON resistance of the transistor 409, the current flowing in the transistor 409 increases, the resistance of the device 410 decreases, the value of current consumer for the generating device 120 increases, and the rotation velocity of the generating device 120 decreases. While, when the rotation velocity of the generating device 120 decreases, the resistance of the device 410 increases, the value of current consumer for the generating device 120 decreases, and the rotation velocity of the generating device 120 increases. As seen from the foregoing explanation, the value of the current consumer is automatically adjusted as the rotation velocity of the generating device 120 changes to keep the rotation velocity of the generating device 120 substantially constant.

Therefore, even if the driving torque changes, the rotation velocity of the generating device 120 is kept constant, the velocity of the operations of the valves are kept constant, the durations of the operations of the valves are kept constant, and the operations of the valves become stable.

A resistor 404 is connected to a resistor 403 in parallel through a switch 405. It is possible to manipulate the switch 405 normally turned OFF to drive the resistor 404 to ON condition, thereby adjusting the value of the current consumer for the generating device 120. A capacitor 402 removes noise, absorbs excessive input current, and prevents malfunction, etc. when the switch 405 is distanced from the device 410 and connected to the device 410 with a signal wire. When the switch 405 can be manipulated from outside of the device 410, it is possible for a user to manipulate the switch 405 to adjust the gate (G) voltage of the transistor 409, thereby adjusting the operation velocities of the valves and the durations of the operations of the valves freely depending on the purpose. When operation of the switch 405 is linked with the manipulation of the control lever 106, it is possible to change the operation velocities of the valves and the durations of the operations of the valves freely only over a predetermined section of the movement or only during a predetermined period, thereby easily carrying out complex control of the operations of the valves and freely changing the quantity of the discharging wash water. When a plurality of operation velocities of the valves different from each other or a plurality of durations of the operations of the valves different from each other are set in advance and a desirable operation velocity or a desirable duration of the operation can be selected, the operations of the valves can be started and stopped safely and surely even if a user not used to the valve controller 105 manipulates it the wrong way or a unexpected malfunction occurs in the mechanism of the valve controller 105.

The MOSFET provided with a depression-enhancement type characteristic can be driven by a micro voltage and controlled by micro current operation. Therefore, it can be driven by a micro electromotive force of the generating device 120. The device 410 provided with the MOSFET can set the value of the current consumer accurately, surely and freely, achieve temperature compensation, and achieve velocity compensation.

A mechanical timer that can be added to the mechanical timer 117 provided for the valve controller 105 will be described.

Figure 23:
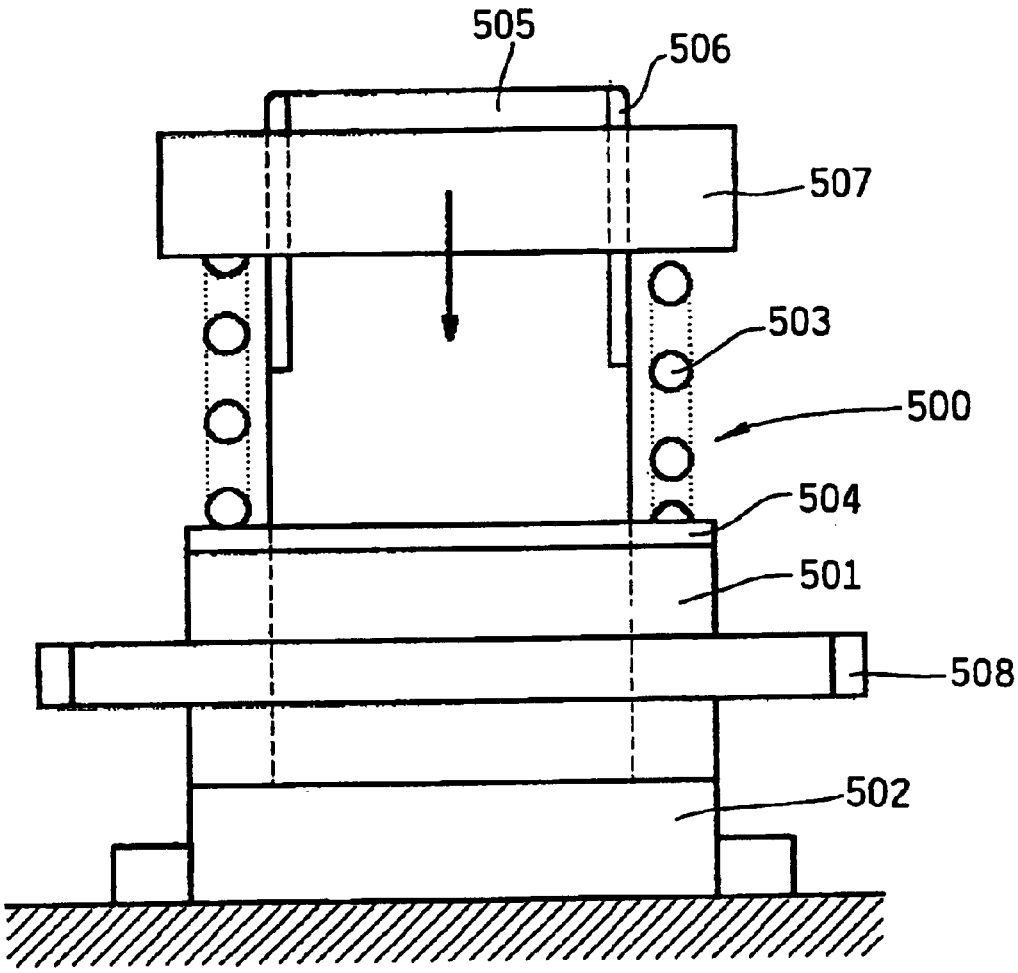
FIG. 23 is a structural view of another mechanical timer.

As shown in FIG. 23, a friction brake 500 is provided with a rotor 501 and a stator 502. A coil spring 503 forces the rotor 501 against the stator 502 through a slip washer 504 to generate bearing pressure in the abutting portion between them. A nut 507 threads on an external thread 506 of a fixed shaft 505. It is possible to adjust the degree of threading of the nut 507 to adjust the bearing pressure in the abutting portion between the rotor 501 and the stator 502. A gear 508 is formed integrally with the rotor 501. The gear 508 meshes the third gear 114 of the valve controller 105. The rotor 501 rotates as the third gear 114 rotates to generate frictional heat in the abutting portion between the rotor 501 and the stator 502. Thus, a part of the strain energy released from the helical coil spring 111 is consumed in the abutting portion between the rotor 501 and the stator 502 to become frictional heat. Frictional resistance appearing in the abutting portion between the rotor 501 and the stator 502 regulates the velocity of the homeward rotation of the first cam 108, the velocities of the rotations of he second cam 113 and the third cam 115, and the duration of the operation of the helical coil spring 111. It is possible to adjust the degree of threading of the nut 507 to adjust the value of the frictional resistance in the abutting portion between the rotor 501 and the stator 502, thereby adjusting the duration of the operation of the helical coil spring 111.

A push button type device for driving the first gear 107 of the valve controller 105 will be described. The device can be used instead of the control lever 106.

Figure 24:
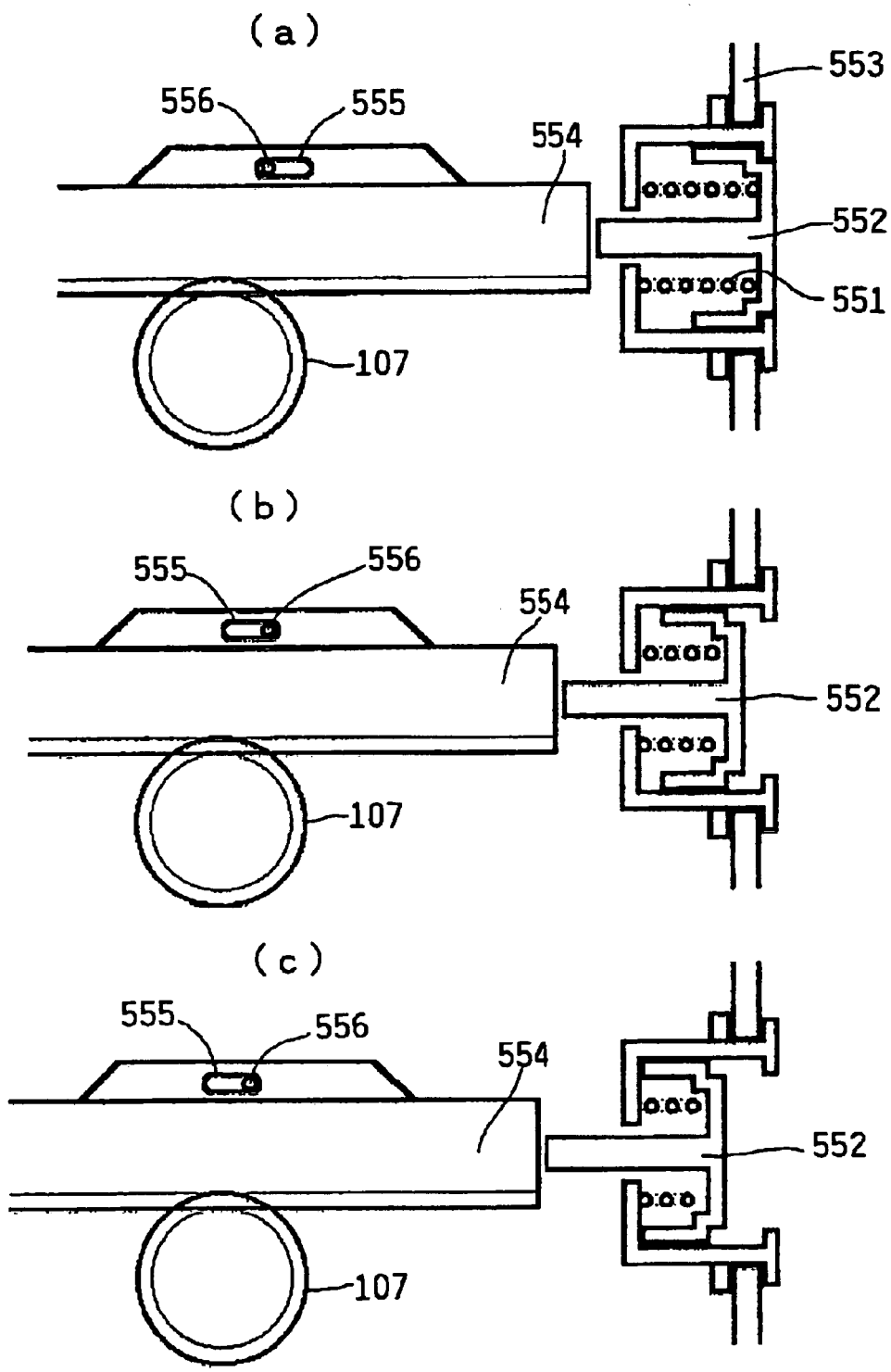
FIG. 24 is a structural view of a push button type starter of the valve controller.

As shown in FIG. 24, a push button 552 forced by a spring 551 is connected to a toilet body 553. When the push button 552 is forced, a rack 554 is driven, the first gear 107 of the valve controller 105 meshing the rack 554 is rotated, and strain energy is accumulated in the helical coil spring 111. The rack 554 is provided with a cam 555. A cam rod 566 engages the cam 555. The cam rod 556 engages the switch 405 of the device 410 or the nut 507 of the friction brake 500.

Before the push button 552 is manipulated, the aforementioned members are in the conditions shown in FIG. 24(*a*), wherein the push button 552 is distanced from the rack 554, and the cam rod 556 abuts the left side end face of the cam 555.

When a user forces the push button 552 to move it by a predetermined distance, the push button 652 abuts the rack 554 to move the rack 554 to a point shown in FIG. 24(*b*). The cam rod 556 abuts the right side end face of the cam 555. The first gear 107 is rotated, strain energy is accumulated in the helical coil spring 111, the first cam 108 rotates to push up the cam rod 14, and the cam rod 14 leaves the rectangular cutout of the second cam 113 outwardly in radial direction. The clutch projection 110*a* has gone up the slope of the clutch projection 110*b* to the head and opposes the next clutch projection 10*b*. The perpendicularly concaving rear end 110*a* " of the clutch projection 110*a* opposes the perpendicularly concaving fore end 110*b*' of the clutch projection 10*b*. When the user removes his or her hand from the push button 552, the helical coil spring 111 releases the accumulated strain energy, the clutch projection 110*a* meshes with the clutch projection 110*b*, the first cam 108 rotates homeward at a predetermined velocity, the second cam 113 and the third cam 115 rotate at predetermined velocities, and the selector valve 3 and the switching valve 2 are switched at predetermined velocities and durations of operations.

When the user forces the push button to move it a little further, the cam rod 556 is driven by the cam 555 as shown in FIG. 24(*c*). Thus, the cam rod 556 turns ON the switch 405 of the device 410 to change the value of current consumer for the generating device 120 or changes the degree of threading of the nut 507 of the friction brake 500 to change the value of frictional resistance in the abutting portion between the rotor 501 and the stator 502. The clutch projection 110*a* has gone up the slope of the clutch projection 110*b* to the middle. When the user removes his or her hand from the push button 552, the helical coil spring 111 releases the accumulated strain energy and the first cam 108 rotates homeward at a high velocity. The clutch projection 110*a* goes down the slope of the clutch projection 10*b* promptly to mesh with the clutch projection 110*b*, the first cam 108 rotates homeward at the changed velocity, the second cam 113 and the third cam 115 rotate, and the selector valve 3 and the switching valve 2 are switched at the changed velocities and operating durations. It is possible to change the velocity of the homeward rotation of the first cam 108, the velocities of rotations of the second cam 113 and the third cam 115, thereby achieving various kinds of flushing modes with different durations of flushing and different quantities of discharging wash water. It is possible to change the velocity of rotation continuously depending on the distance of the movement of the push button 552 instead of changing the velocity of rotation alternatively.

Figure 25:
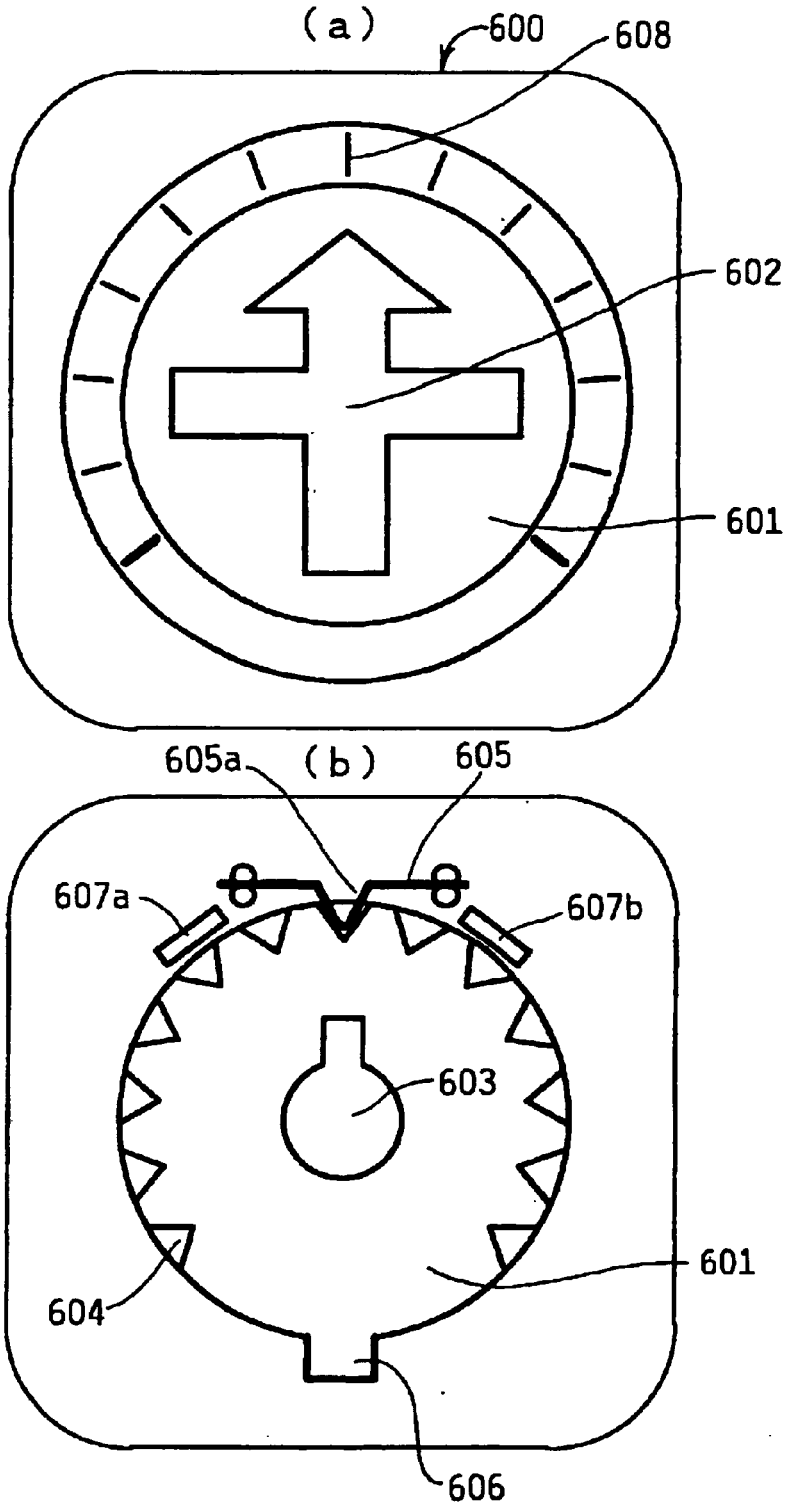
FIG. 25 is a structural view of a setting device of the current consumer provided for the mechanical timer.

An example of a device for setting the value of current consumer is shown in FIG. 25. (*a*) is a plan view and (*b*) is a horizontal sectional view. When a user engages a driver with a cross shaped groove 602 formed on an adjusting knob 601 of a device for setting the value of current consumer to rotate the adjusting knob 601, a shaft 603 rotates integrally with the adjusting knob 601, the rotation of the shaft 603 is transmitted to the nut 507 of the friction brake 500 to adjust the degree of threading of the nut 507, the value of the frictional resistance in the abutting portion between the rotor 501 and the stator 502 is adjusted, and the velocity of operation and the velocity of duration of operation of the valve controller 105 is adjusted. It is possible to transmit the rotation of the shaft 603 to a control lever of the resistance R1 or R2 of the mechanical timer 117, thereby driving the control lever of the resistance R1 or R2 structured as a variable resistor, adjusting the value of the resistance, and adjusting the velocity of operation and the velocity of duration of operation of the valve controller 105. An engaging projection 605*a* of a fixed plate spring 605 engages one of engaging grooves 604 formed on the circumferential surface of the adjusting knob 601 at a constant pitch. Thus, the adjusting knob 601 or the shaft 603 rotates stepwise and discontinuously. An engaging projection 606 formed on the adjusting knob 601 abuts a stopper 607*a* or a stopper 607*b* to prevent the adjusting knob 601 from rotating excessively due to wrong manipulation. An arrow formed by a part of the groove 602 indicates a division 608 to indicate the present set value of current consumer clearly. The device 600 makes it possible to adjust the value of the current consumer easily and surely.

The structure of the mechanical timer is not limited to those in the aforementioned embodiments. City water, oil, etc. can be used as the operating fluid of the mechanical timer A. Any kind of motor such as a stepping motor, a synchronous motor, a brushless motor, DC brushless motor, etc. can be used for the generating device 120 of the mechanical timer 17.

INDUSTRIAL APPLICABILITY OF THE INVENTION

The flush toilet of the present invention can be used widely as a water-saving flush toilet adapted to be usable even at an electric service interruption.

What is claimed is:

1. A flush toilet comprising a toilet body, a water supply pipe connected to supply wash water, a discharge port connected to discharge wash water, a valve disposed between the water supply pipe and the discharge port, a valve switching device operably connected to switch the valve, a spring connected to drive the valve switching device, a mechanical timer, comprising a generator driven by the spring and a variable resistor connected to the generator, and a starter operably connected to supply the spring with strain energy, wherein the spring releases the strain energy accumulated in it to drive the valve switching device, the mechanical timer consumes a part of the strain energy released from spring to regulate a duration of the operation of the spring, the variable resistor is connected to adjust the rate of the strain energy consumption by the mechanical timer to adjust the duration of the operation of the spring, and the variable resistor is selectable among a plurality of different rates of strain energy consumption.

2. A flush toilet of claim 1, wherein the rate of strain energy consumption by the mechanical timer increases and decreases as the driving velocity of the spring increases and decreases.

3. A flush toilet of claim 1, further comprising a switch for being manipulated to manipulate the variable resistor.

4. A flush toilet of claim 1, wherein the variable resistor is manipulated with the starter.

5. A flush toilet of claim 1, wherein the valve comprises a pilot-operated valve.

6. A flush toilet of claim 5, further comprising a pipe connecting a pilot valve portion of the pilot-operated valve with a switching valve portion of the pilot-operated valve.

7. A flush toilet of claim 1, wherein the flush toilet comprises a plurality of the discharge ports, and the valve comprises a switching valve disposed on a wash water passage extending from the water supply pipe and a selector valve for alternatively supplying one of the discharge ports with wash water.

8. A flush toilet of claim 7, wherein the selector valve is disposed downstream of the switching valve and connected to the switching valve in series.

9. A flush toilet of claim 7, further comprising a starter that is operably connected and manipulatable to open the switching valve.

10. A flush toilet of claim 9, wherein said starter operably connected and manipulatable to supply the spring with strain energy comprises the starter operably connected and manipulatable to open the switching valve.

11. A flush toilet of claim 7, wherein the valve switching device comprises a first cam for opening the switching valve and a second cam for closing the switching valve, the first cam has a shape adapted to gradually open the switching valve, and the second cam has a shape adapted to rapidly close the switching valve.

12. A flush toilet of claim 7, wherein the valve switching device comprises a third cam for switching the selector valve, and the third cam has a shape adapted to gradually open the selector valve and rapidly close the selector valve.

13. A flush toilet of claim 7, wherein the valve switching device opens the switching valve in its outward movement.

14. A flush toilet of claim 1, further comprising a flow control valve for regulating flow rate of the wash water.

15. A flush toilet of claim 1, wherein the flow control valve is flow regulating valve for achieving a constant flow rate.

16. A flush toilet of claim 1, further comprising a case for receiving the valve, the valve switching device, the spring, and the mechanical timer.

17. A flush toilet of claim 1, further comprising a stopper for regulating a manipulated variable of the starter at a predetermined level.

18. A flush toilet of claim 1, wherein the valve switching device moves reciprocally and its operation in the outward movement is asymmetrical with that in the homeward movement.

19. A flush toilet of claim 18, wherein the valve switching device comprises a cam and a cam engaging member for engaging the cam with the valve alternatively at the outward movement of the valve switching device or at the homeward movement of the valve switching device.

20. A flush toilet of claim 19, wherein the valve switching device comprises a spring for forcing the cam engaging member to a position where the cam engaging member can engage the cam.

21. A flush toilet of claim 19, wherein the cam engaging member and the cam move reciprocally in one united body.

22. A flush toilet of claim 18, further comprising a projection provided for the starter for controlling the stroke of the reciprocal movement of the valve switching device.

23. A flush toilet of claim 1, wherein the valve switching device is driven only by the spring.

24. A flush toilet of claim 1, further comprising a return spring for releasing the engagement of the starter with the spring after the operation of the starter for supplying the spring with strain energy is completed to return the starter to the start point.

25. A flush toilet of claim 1, wherein the valve closes under the upstream pressure.

26. A flush toilet of claim 1, wherein the valve switching device comprises a cam.

27. A flush toilet of claim 26, wherein the cam is provided with a shape wherein the component of a force applied from the cam to the valve in the direction of switching of the valve is larger than that in the direction at right angles to the aforementioned direction.

28. A flush toilet of claim 1, wherein the valve switching device comprises a plurality of cams and the shape of a cam for switching the valve in the outward movement of the valve switching device is different from that of a cam for switching the valve in the homeward movement of the valve switching device.

* * * * *